US009322304B2

(12) United States Patent
Kato

(10) Patent No.: US 9,322,304 B2
(45) Date of Patent: Apr. 26, 2016

(54) VARIABLE VALVE ACTUATION APPARATUS OF INTERNAL COMBUSTION ENGINE

(71) Applicant: HITACHI AUTOMOTIVE SYSTEMS, LTD., Hitachinaka-shi, Ibaraki (JP)

(72) Inventor: Hiroyuki Kato, Kanagawa (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 85 days.

(21) Appl. No.: 14/489,051

(22) Filed: Sep. 17, 2014

(65) Prior Publication Data

US 2015/0075461 A1 Mar. 19, 2015

(30) Foreign Application Priority Data

Sep. 19, 2013 (JP) ..... 2013-194159

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34423* (2013.01); *F01L 2001/34453* (2013.01); *F01L 2001/34463* (2013.01); *F01L 2001/34466* (2013.01); *F01L 2001/34469* (2013.01); *F01L 2250/02* (2013.01)

(58) Field of Classification Search
CPC ..... F01L 1/3442; F01L 2001/34423; F01L 2001/34453; F01L 2001/34469; F01L 2001/34463; F01L 2001/34466
USPC ..... 123/90.15, 90.17
See application file for complete search history.

(56) References Cited

U.S. PATENT DOCUMENTS 8,677,965 B2 3/2014 Kato et al.
9,004,029 B2 * 4/2015 Watanabe ..... F01L 1/34 123/90.15
2012/0017857 A1 1/2012 Kato et al.

FOREIGN PATENT DOCUMENTS

JP 2012-026275 A 2/2012

* cited by examiner

*Primary Examiner* — Ching Chang
(74) *Attorney, Agent, or Firm* — Foley & Lardner LLP

(57) ABSTRACT

A variable valve actuation apparatus includes a lock pin slidably disposed in a slide bore formed in a rotor of a vane rotor, a retaining hole formed in an inner face of a sprocket, and a lock-hole structural member fixed and press-fitted into the retaining hole and configured to form the lock hole. The retaining hole is formed at the innermost peripheral side of the sprocket so as to face a central support bore of the sprocket. The inner end face of a large-diameter bore of the retaining hole is formed as a flat surface, whereas the outer end face of a lock-hole structural section of the lock-hole structural member is formed as a planar section. The lock-hole structural member is precisely positioned in its rotation direction by abutment between the flat inner end face and the planar outer end face.

20 Claims, 11 Drawing Sheets

VARIABLE VALVE ACTUATION APPARATUS OF INTERNAL COMBUSTION ENGINE

TECHNICAL FIELD

The present invention relates to a variable valve actuation apparatus of an internal combustion engine for variably controlling valve timing of an engine valve, such as an intake valve and/or an exhaust valve, depending on an engine operating condition.

BACKGROUND ART

In recent years, there have been proposed and developed various hydraulically-operated vane rotor equipped variable valve timing control (VTC) devices, capable of locking a vane rotor at an intermediate phase angular position (simply, an intermediate phase position) between a maximum phase-advance position and a maximum phase-retard position. One such hydraulically-operated vane rotor equipped variable valve timing control device has been disclosed in Japanese Unexamined Patent Application Publication No. 2012-026275 (hereinafter is referred to as "JP2012-026275"), corresponding to U.S. Pat. No. 8,677,965, issued on Mar. 25, 2014. The valve timing control device disclosed in JP2012-026275 is equipped with a driving rotary member configured to define therein a working-fluid chamber, a vane rotor fixedly connected to a camshaft and configured to partition the working-fluid chamber into a phase-advance hydraulic chamber and a phase-retard hydraulic chamber and configured to rotate in a phase-advance direction or in a phase-retard direction with respect to the driving rotary member, a phase-change mechanism configured to rotate the vane rotor with respect to the driving rotary member in the phase-advance direction or in the phase-retard direction by supplying working fluid to one of the phase-advance hydraulic chamber and the phase-retard hydraulic chamber and discharging working fluid from the other for changing a phase of the engine valve, and a position-hold mechanism configured to lock or hold a relative-rotation position of a vane rotor to the driving rotary member at an intermediate phase position between a maximum phase-advance position and a maximum phase-retard position.

The position-hold mechanism is comprised of a lock pin slidably disposed in a vane of the vane rotor, and a lock-hole structural member that is configured to be press-fitted into a recessed portion formed in a rear plate (a rear cover) of the driving rotary member for forming a lock hole with which the lock pin is brought into and out of engagement.

During an engine stopping period, the lock pin advances toward the lock hole by the spring force of a return spring. Owing to the advancing-movement of the lock pin into engagement with the lock hole, the vane rotor is locked at the intermediate phase position with respect to the driving rotary member. With the vane rotor locked at the intermediate phase position, for instance during engine cold-start operation, a good startability can be ensured.

SUMMARY OF THE INVENTION

By the way, the front opening end of the lock hole, facing the working-fluid chamber, and a clearance space between the previously-discussed recessed portion formed in the rear plate (the rear cover) and the lock-hole structural member are sealed by the opposing side face of the vane rotor during rotation of the vane rotor relative to the driving rotary member.

However, in the VTC device disclosed in the Patent document 1; the lock-hole structural member is formed substantially at a midpoint of the rear plate (the rear cover) in the radial direction. To ensure a good sealing action, i.e., a satisfactory seal performance between the recessed portion and the lock-hole structural member by the opposing side face of the vane rotor, the outside diameter of the vane rotor has to be increased. Hence, the outside diameter of the driving rotary member also has to be increased, and as a result the total size of the VTC device has to be increased.

It is, therefore, in view of the previously-described drawbacks of the prior art, an object of the invention to provide a variable valve actuation apparatus of an internal combustion engine capable of decreasing the total size of the apparatus by reducing the outside diameter of a driving rotary member as much as possible and more certainly locating or positioning a lock-hole structural member with respect to a recessed portion formed in the driving rotary member.

In order to accomplish the aforementioned and other objects of the present invention, a variable valve actuation apparatus of an internal combustion engine, comprises a driving rotary member adapted to be driven by a crankshaft of the engine and configured to define therein a working-fluid chamber, a vane rotor adapted to be fixedly connected to a camshaft and configured to partition the working-fluid chamber into a phase-advance hydraulic chamber and a phase-retard hydraulic chamber and configured to relatively rotate in either one of a phase-advance direction and a phase-retard direction with respect to the driving rotary member by selectively supplying working fluid to one of the phase-advance hydraulic chamber and the phase-retard hydraulic chamber and draining working fluid from the other of the phase-advance hydraulic chamber and the phase-retard hydraulic chamber, a slide bore formed in the vane rotor as an axial through hole extending along an axial direction of the camshaft, a lock member slidably disposed in the slide bore, a retaining hole formed in an inner face of the driving rotary member so as to face the working-fluid chamber, and a lock-hole structural member fixed into the retaining hole and configured to form a lock hole with which a tip of the lock member is brought into engagement when the vane rotor has relatively rotated to a predetermined angular position with respect to the driving rotary member, wherein a flat surface is formed along a given part of an inner peripheral surface of the retaining hole, and wherein a planar section is formed along a given part of an outer peripheral surface of the lock-hole structural member, the planar section being configured to abut the flat surface of the retaining hole.

According to another aspect of the invention, a variable valve actuation apparatus of an internal combustion engine, comprises a driving rotary member adapted to be driven by a crankshaft of the engine and configured to define therein a working-fluid chamber, a vane rotor adapted to be fixedly connected to a camshaft and configured to partition the working-fluid chamber into a phase-advance hydraulic chamber and a phase-retard hydraulic chamber and configured to relatively rotate in either one of a phase-advance direction and a phase-retard direction with respect to the driving rotary member by selectively supplying working fluid to one of the phase-advance hydraulic chamber and the phase-retard hydraulic chamber and draining working fluid from the other of the phase-advance hydraulic chamber and the phase-retard hydraulic chamber, a slide bore formed in the vane rotor as an axial through hole extending along an axial direction of the camshaft, a lock member slidably disposed in the slide bore, a stepped recessed portion formed in an inner face of the driving rotary member so as to face the working-fluid chamber, and a lock-hole structural member fixed into the stepped recessed portion and configured to form a lock hole with which a tip of the lock member is brought into engagement when the vane rotor has relatively rotated to a predetermined angular position with respect to the driving rotary member, wherein a flat surface is formed along a given part of an inner peripheral surface of the stepped recessed portion, and wherein a planar section is formed along a given part of an outer peripheral surface of the lock-hole structural member, the planar section being configured to abut the flat surface of the stepped recessed portion.

The other objects and features of this invention will become understood from the following description with reference to the accompanying drawings.

BRIEF DESCRIPTION OF THE DRAWINGS

FIG. 2A is a sectional view taken along the line A-A of FIG. 1, showing a housing body and a sprocket of a housing of the embodiment, whereas

FIG. 3A is a sectional view taken along the line C-C of FIG. 2A, showing a state before press-fitting the first lock-hole structural member into a first retaining hole, whereas

DESCRIPTION OF THE PREFERRED EMBODIMENTS

In the following, embodiments of a variable valve actuation apparatus of an internal combustion engine according to the invention will be described in detail with reference to the drawings. The variable valve actuation apparatus of the embodiments is exemplified in a variable valve timing control (VTC) device mounted on the intake valve side of an internal combustion engine.

[First Embodiment]

Figure 1:
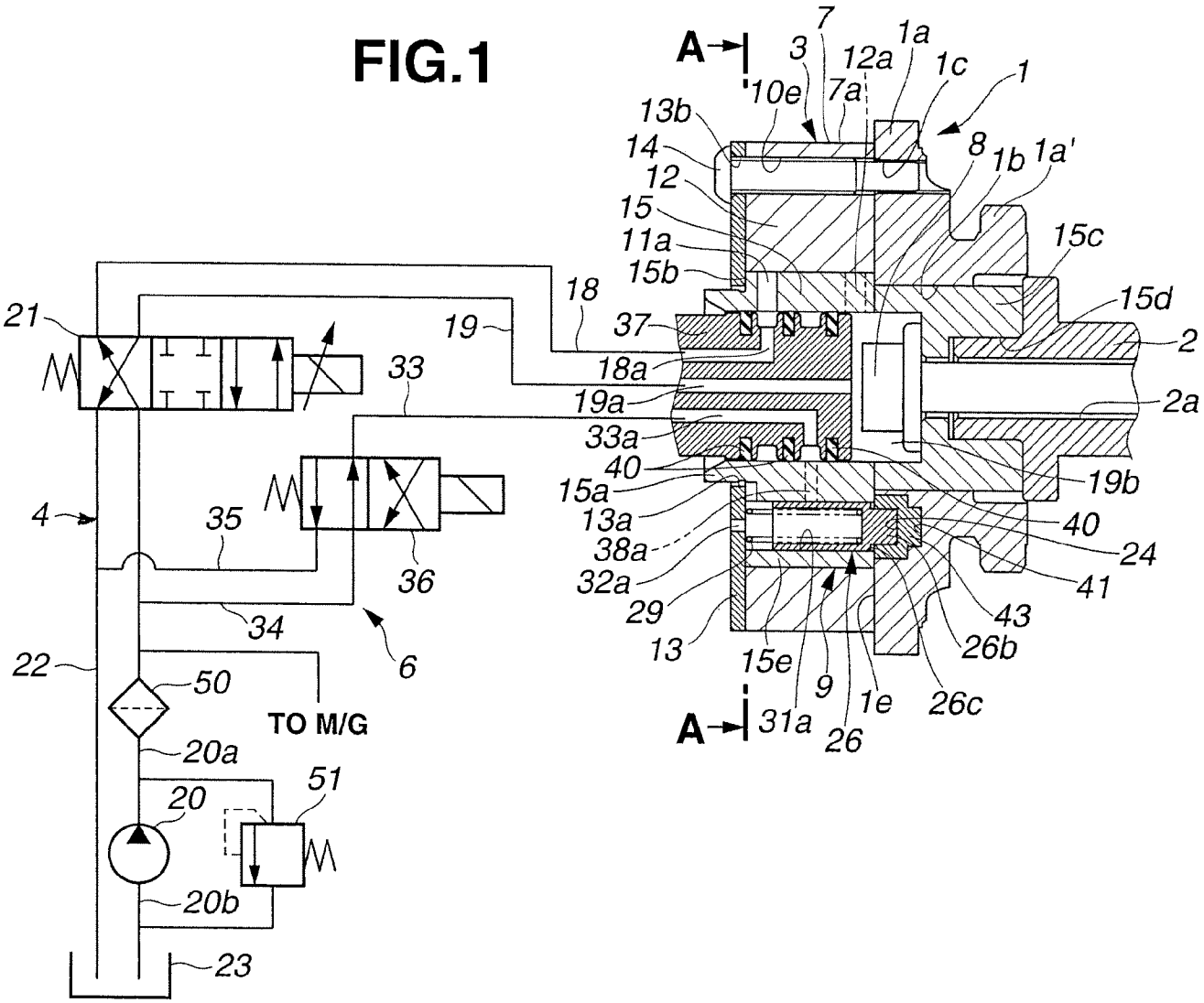
FIG. 1 is a general system block diagram illustrating a system configuration of an embodiment of a variable valve actuation apparatus (a valve timing control (VTC) device) according to the invention.
Figure 4:
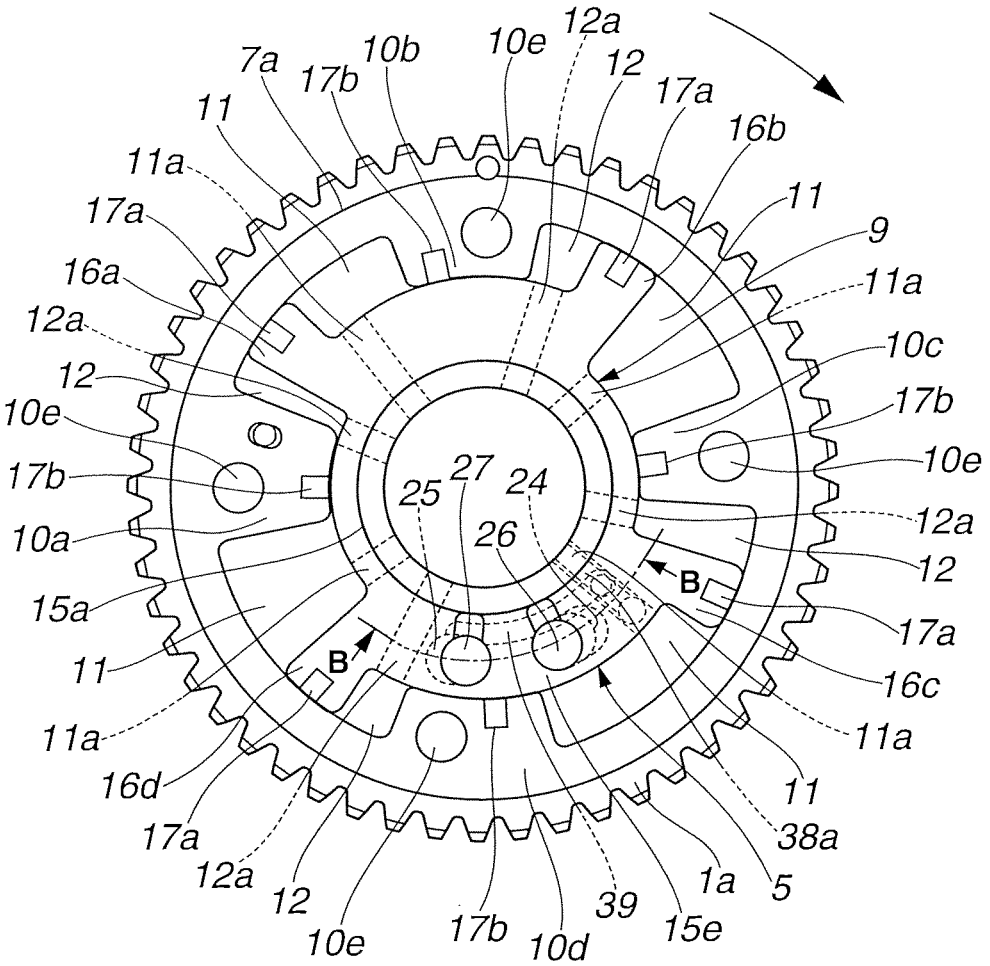
FIG. 4 is a sectional view taken along the line A-A of FIG. 1, showing a state where a vane rotor of the embodiment has been held at an intermediate phase position.

As shown in FIGS. 1 and 4, the valve timing control device is comprised of a sprocket 1 constructing a part of a driving rotary member driven by an engine crankshaft via a timing chain, an intake camshaft 2 arranged along the longitudinal direction of the engine and configured to be rotatable relative to the sprocket 1, a phase-change mechanism 3 interposed between the sprocket 1 and the camshaft 2 for changing an angular phase of the camshaft 2 relative to the sprocket 1, a first hydraulic circuit 4 that hydraulically operates the phase-change mechanism 3, a position-hold mechanism 5 (see FIG. 4) configured to hold an angular phase (an angular position) of camshaft 2 relative to sprocket 1 via the phase-change mechanism 3 at a predetermined intermediate phase position (see FIG. 4) between a maximum phase-retard position (see FIG. 5) and a maximum phase-advance position (FIG. 6), and a second hydraulic circuit 6 that hydraulically operates the position-hold mechanism 5.

Sprocket 1 is formed into a thick-walled disk shape, and has a large-diameter toothed gear portion 1*a* on which a timing chain (not shown) is wound and a small-diameter toothed gear portion 1*a*' on which a chain (not shown) for drive of engine accessories is wound. Large-diameter toothed gear portion 1*a* and small-diameter toothed gear portion 1*a*' construct a sprocket gear. Sprocket 1 also serves as a rear cover (a rear plate) that hermetically covers the rear opening end of a housing (described later). Sprocket 1 is formed with a central support bore 1*b* (an axial through hole) rotatably supported on the outer periphery of a vane rotor (described later) fixedly connected to the camshaft 2. The outer peripheral portion of sprocket 1 is formed with four circumferentially-spaced female screw threaded holes 1*c*, 1*c*, 1*c*, 1*c* into which respective bolts 14, 14, 14, 14 (described later) are screwed.

Camshaft 2 is rotatably supported on a cylinder head (not shown) via cam bearings (not shown). Camshaft 2 has a plurality of cams integrally formed on its outer periphery and spaced apart from each other in the axial direction of the camshaft, for operating engine valves (i.e., intake valves). Camshaft 2 has a female screw threaded hole 2*a* formed along the camshaft center at one axial end.

As best seen in FIGS. 1 and 4, phase-change mechanism 3 is comprised of a housing 7, a vane rotor 9, and four phase-retard hydraulic chambers 11, 11, 11, 11 and four phase-advance hydraulic chambers 12, 12, 12, 12. Housing 7 is integrally connected to the front face of sprocket 1 in the axial direction so as to define a working-fluid chamber in the housing. Vane rotor 9 is fixedly connected to the one axial end of camshaft 2 by means of a cam bolt 8, which is screwed into the female screw threaded hole 2*a*, and serves as a driven rotary member installed in the housing 7 such that the driven rotary member rotates relatively to the housing. Four phase-retard hydraulic chambers 11 and four phase-advance hydraulic chambers 12 are defined in the housing 7 by partitioning the working-fluid chamber by the vane rotor 9 and four shoes (namely, a first shoe 10*a*, a second shoe 10*b*, a third shoe 10*c*, and a fourth shoe 10*d*) integrally formed on the inner peripheral surface of housing 7.

Housing 7 is constructed by a housing body 7*a*, a front cover 13, and the sprocket 1. Housing body 7*a* is made of sintered alloy materials, such as iron-based sintered alloy materials, and formed into a substantially cylindrical shape to define the above-mentioned working-fluid chamber. Front cover 13 is produced by pressing, and provided for hermetically covering the front opening end of housing body 7*a*. As previously discussed, sprocket 1 serves as the rear cover for hermetically covering the rear opening end of housing 7. Housing body 7*a*, front cover 13, and sprocket 1 are integrally connected to each other by fastening them together with four bolts 14, 14, 14, 14 penetrating respective bolt insertion holes (i.e., four through holes 13*b* formed in the front cover 13 and four through holes 10*e* formed in respective shoes 10*a*-10*d*) and screwed into respective female screw threaded holes 1*c* of sprocket 1. Front cover 13 is formed with a central through hole 13*a*. As previously discussed, the outer peripheral portion of front cover 13 is also formed with four circumferentially-spaced bolt insertion holes 13*b*.

Vane rotor 9 is formed of a metal material. Vane rotor 9 is comprised of a rotor 15 fixedly connected to the axial end of camshaft 2 by means of the cam bolt 8, and four radially-extending vane blades (simply, vanes) 16*a*, 16*b*, 16*c*, and 16*d*, formed on the outer periphery of rotor 15 and circumferentially spaced apart from each other by approximately 90 degrees.

Rotor 15 is formed into a substantially cylindrical-hollow shape, extending longitudinally (axially). Rotor 15 has a thin-walled cylindrical-hollow chamfered insertion guide portion 15*a* formed integral with the rotor front end face 15*b* and located at a substantially center of the front end face 15*b*. The rear end portion 15*c* of rotor 15 is configured to extend toward the one axial end of camshaft 2. Additionally, the rear end portion 15*c* of rotor 15 is formed with a cylindrical-hollow fitting groove 15*d*.

Figure 5:
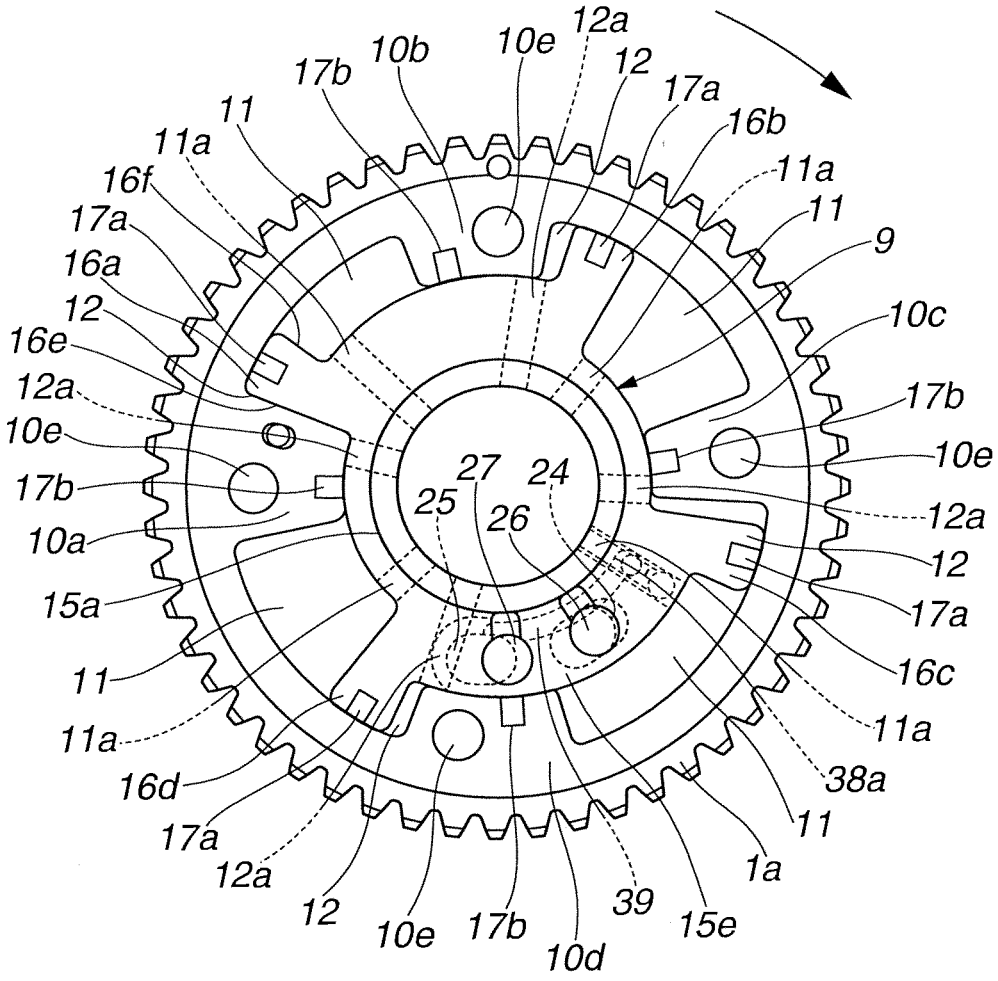
FIG. 5 is a sectional view taken along the line A-A of FIG. 1, showing a state where the vane rotor of the embodiment has been rotated to a maximum phase-retard position.
Figure 6:
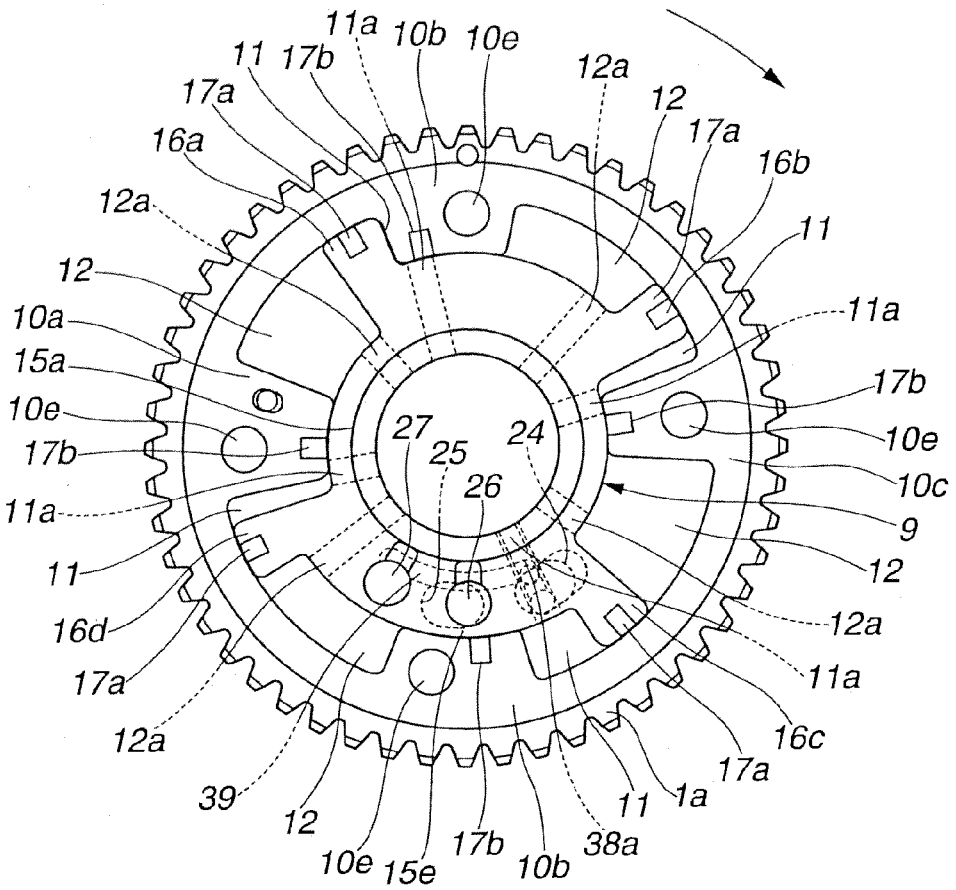
FIG. 6 is a sectional view taken along the line A-A of FIG. 1, showing a state where the vane rotor of the embodiment has been rotated to a maximum phase-advance position.

As seen in FIGS. 4-6, the first vane 16*a*, the second vane 16*b*, the third vane 16*c*, and the fourth vane 16*d* are disposed in respective internal spaces defined by four shoes 10*a*-10*d*. Circumferential widths of four vanes 16*a*-16*d* are dimensioned to be substantially identical to each other. Four vanes 16*a*-16*d* have respective axially-elongated seal retaining grooves, formed in their circular-arc shaped outermost ends (apexes) and extending in the axial direction. Each of the four seal retaining grooves of vanes 16*a*-16*d* is formed into a substantially rectangle. Four oil seal members (four apex seals) 17*a*, 17*a*, 17*a*, 17*a*, each having a substantially square lateral cross section, are fitted into the respective seal retaining grooves of four vanes 16*a*-16*d* so as to bring the four apex seals 17*a* into sliding-contact with the inner peripheral surface of housing body 7*a*. In a similar manner to the vanes 16*a*-16*d*, four shoes 10*a*-10*d* have respective axially-elongated seal retaining grooves, formed in their innermost ends (apexes) and extending in the axial direction. Each of the four seal retaining grooves of shoes 10*a*-10*d* is formed into a substantially rectangle. Four oil seal members (four apex seals) 17*b*, 17*b*, 17*b*, 17*b*, each having a substantially square lateral cross section, are fitted into the respective seal retaining grooves of four shoes 10*a*-10*d* so as to bring the four apex seals 17*b* into sliding-contact with the outer peripheral surface of rotor 15.

As shown in FIG. 5, when vane rotor 9 rotates relative to the housing 7 (or the sprocket 1) in the maximum phase-retard side, one side face (an anticlockwise side face 16*e*, viewing FIG. 5) of the first vane 16*a* is brought into abutted-engagement with a radially-inward protruding surface formed on one side face (a clockwise side face, viewing FIG. 5) of the opposed first shoe 10*a*, and thus a maximum phase-retard angular position of vane rotor 9 is restricted. As shown in FIG. 6, conversely when vane rotor 9 rotates relative to the housing 7 (or the sprocket 1) in the maximum phase-advance side, the other side face (a clockwise side face, viewing FIG. 6) of the first vane 16*a* is brought into abutted-engagement with a radially-inward protruding surface formed on one side face (an anticlockwise side face, viewing FIG. 6) of the opposed second shoe 10*b*, and thus a maximum phase-advance angular position of vane rotor 9 is restricted. That is, the second shoe 10*b* cooperates with the first vane 16*a* to provide a stopper function (i.e., a maximum phase-advance side stopper) for restricting a maximum phase-advance angular position of vane rotor 9 (in other words, rotary motion of vane rotor 9 relative to sprocket 1 in the phase-advance direction). In a similar manner, the first shoe 10*a* cooperates with the first vane 16*a* to provide a stopper function (i.e., a maximum phase-retard side stopper) for restricting a maximum phase-retard angular position of vane rotor 9 (in other words, rotary motion of vane rotor 9 relative to sprocket 1 in the phase-retard direction).

With the first vane 16*a* kept in its maximum phase-retard angular position (see FIG. 5) or with the first vane 16*a* kept in its maximum phase-advance angular position (see FIG. 6), both side faces of each of the other vanes 16*b*-16*d* are kept in a spaced, contact-free relationship with respective side faces of the associated shoes. Hence, the accuracy of abutment between the vane rotor and the shoe can be enhanced, and additionally the speed of hydraulic pressure supply to each of hydraulic chambers 11 and 12 can be increased, and thus a responsiveness of normal-rotation/reverse-rotation of vane rotor 9 can be improved.

Regarding the shape of rotor 15, in particular, the lateral cross-section of rotor 15, the contour between the third vane 16*c* and the fourth vane 16*d* circumferentially adjacent to each other is configured as a large-diameter portion 15*e*. Large-diameter portion 15*e* is configured to connect the circumferentially-opposed side faces of the third vane 16*c* and the fourth vane 16*d* and formed into a circular-arc shape with respect to the axis of rotor 15. The outer peripheral surface of large-diameter portion 15*e* is configured to extend to a substantially center position of each of phase-advance hydraulic chamber 12 and phase-retard hydraulic chamber 11 in the radial direction. As viewed in the axial direction (see the lateral cross-sections of FIGS. 4-5), the radial width (the radial length) of large-diameter portion 15*e* is dimensioned to be uniform.

As shown in FIG. 4, the previously-discussed four phase-retard hydraulic chambers 11 and four phase-advance hydraulic chambers 12 are defined by partitioning the working-fluid chamber by both side faces (in the normal-rotational direction and in the reveres-rotational direction) of each of vanes 16*a*-16*d* and both side faces of each of shoes 10*a*-10*d*. Phase-retard hydraulic chambers 11 are configured to communicate with the first hydraulic circuit 4 via respective first communication holes 11*a* formed in the rotor 15. In a similar manner, phase-advance hydraulic chambers 12 are configured to communicate with the first hydraulic circuit 4 via respective second communication holes 12*a* formed in the rotor 15.

Returning to FIG. 1, the first hydraulic circuit 4 is configured to selectively supply working fluid (hydraulic pressure) to one of a group of phase-retard hydraulic chambers 11 and a group of phase-advance hydraulic chambers 12, and drain working fluid (hydraulic pressure) from the other. As shown in FIG. 1, the first hydraulic circuit 4 includes a phase-retard hydraulic passage 18, a phase-advance hydraulic passage 19, an oil pump 20 (serving as a fluid-pressure supply source), and a first electromagnetic directional control valve (a first control valve) 21. Phase-retard hydraulic passage 18 is provided for hydraulic-pressure supply-and-discharge for each of phase-retard hydraulic chambers 11 via the first communication hole 11*a* bored in the radial direction of rotor 15. Phase-advance hydraulic passage 19 is provided for hydraulic-pressure supply-and-discharge for each of phase-advance hydraulic chambers 12 via the second communication hole 12*a* bored in the radial direction of rotor 15. Oil pump 20 is provided for selectively supplying working fluid (hydraulic pressure) to either one of phase-retard hydraulic passage 18 and phase-advance hydraulic passage 19. First electromagnetic directional control valve 21 is provided for switching among a variety of flow path configurations related to the phase-retard hydraulic passage 18, the phase-advance hydraulic passage 19, a discharge passage 20*a* (described later) of oil pump 20, and a drain passage 22 (described later), depending on an engine operating condition. For instance, in the shown embodiment, an internal gear rotary pump, such as a typical trochoid pump having inner and outer rotors, is used as the oil pump 20 driven by the engine crankshaft. One end of phase-retard hydraulic passage 18 and one end of phase-advance hydraulic passage 19 are connected to respective ports of the first electromagnetic directional control valve 21. The other end of phase-retard hydraulic passage 18 is configured to communicate with each of phase-retard hydraulic chambers 11 via an axially-extending but partly-radially-bent phase-retard passage portion 18*a* formed in a substantially cylindrical fluid-passage structural member 37 fitted into the cylindrical-hollow rotor 15 through the chamfered insertion guide portion 15*a* and the first communication hole 11*a* formed in the rotor 15. In a similar manner, the other end of phase-advance hydraulic passage 19 is configured to communicate with each of phase-advance hydraulic chambers 12 via an axial phase-advance passage portion 19*a* formed in the fluid-passage structural member 37, a hydraulic chamber 19*b* formed in the cylindrical-hollow rotor 15 and defined around the head of cam bolt 8, and the second communication hole 12*a* formed in the rotor 15.

The outside portion of fluid-passage structural member 37 is fixed to a chain cover (not shown). That is, fluid-passage structural member 37 is stationary and thus constructed as a non-rotary member. Fluid-passage structural member 37 has a passage portion connected to the second hydraulic circuit 6 provided for unlocking a lock of a lock mechanism (described later), in addition to the passage portions 18*a* and 19*a*.

As appreciated from the system block diagram of FIG. 1, the first electromagnetic directional control valve 21 is a solenoid-actuated four-port, three-position, spring-offset proportional control valve. First electromagnetic directional control valve 21 is comprised of a substantially cylindrical-hollow, axially-elongated valve body (a valve housing), a valve spool (an electrically-actuated valve element) slidably installed in the valve body in a manner so as to axially slide in a very close-fitting bore of the valve body, a valve spring installed inside of one axial end of the valve body for permanently biasing the valve spool in an axial direction, and an electromagnetic solenoid (an electromagnetic coil) attached to the valve body so as to cause axial sliding movement of the valve spool against the spring force of the valve spring. Depending on a given axial position of the valve spool shifted by electric-current control via an electronic controller (not shown), fluid-communication between the discharge passage 20*a* of oil pump 20 and one of phase-retard hydraulic passage 18 and phase-advance hydraulic passage 19 is established, while fluid-communication between the drain passage 22 and the other of phase-retard hydraulic passage 18 and phase-advance hydraulic passage 19 is established.

A suction passage 20*b* of oil pump 20 and the drain passage 22 are configured to communicate with the interior of an oil pan 23. An oil filter 50 is disposed in the downstream side of the discharge passage 20*a* of oil pump 20. Also, the downstream side of the discharge passage 20*a* is configured to communicate with a main oil gallery M/G, such that part of working fluid discharged from oil pump 20 is delivered through the main oil gallery M/G to sliding or moving engine parts. Furthermore, a flow control valve 51 is provided to appropriately control an amount of working fluid discharged from oil pump 20 into discharge passage 20*a*, thus enabling surplus working fluid discharged from oil pump 20 to be directed to the oil pan 23.

The electronic controller generally comprises a microcomputer. The controller includes an input/output interface (I/O), memories (RAM, ROM), and a microprocessor or a central processing unit (CPU). The input/output interface (I/O) of the controller receives input information from various engine/vehicle sensors, namely a crank angle sensor (a crank position sensor), an airflow meter, an engine temperature sensor (e.g., an engine coolant temperature sensor), a throttle opening sensor (a throttle position sensor), a cam angle sensor, and the like. The crank angle sensor is provided for detecting revolution speeds of the engine crankshaft and for calculating an engine speed. The airflow meter is provided for generating an intake-air flow rate signal indicating an actual intake-air flow rate or an actual air quantity. The engine temperature sensor is provided for detecting an actual operating temperature of the engine. The cam angle sensor is provided for detecting latest up-to-date information about an angular phase of camshaft 2. Within the controller, the central processing unit (CPU) allows the access by the I/O interface of input informational data signals from the previously-discussed engine/vehicle sensors, so as to detect the current engine operating condition, and also to generate a control pulse current, determined based on latest up-to-date information about the detected engine operating condition, to the electromagnetic solenoid coil of each of the first electromagnetic directional control valve 21 and a second electromagnetic directional control valve 36 (described later), for controlling the axial position of each of the sliding valve spools of directional control valves 21 and 36, thus achieving selective switching among the ports depending on the controlled axial position of each of the valve spools.

As shown in FIGS. 1, 2A-2B, 4, and 7, position-hold mechanism 5 is mainly comprised of a first retaining hole 41, a second retaining hole 42, a first lock-hole structural member 43, a second lock-hole structural member 44, a first lock hole 24, a second lock hole 25, a first lock pin 26, a second lock pin 27, and the second hydraulic circuit 6 (see FIG. 1). The first retaining hole 41 and the second retaining hole 42 are formed in the inner face 1*e* of sprocket 1 and configured within a circumferential area substantially conformable to the large-diameter portion 15*e* of rotor 15. The first lock-hole structural member 43 is press-fitted into the first retaining hole 41, whereas the second lock-hole structural member 44 is press-fitted into the second retaining hole 42. The first lock hole 24 serves as a first lock recessed portion formed in the first lock-hole structural member 43, whereas the second lock hole 25 serves as a second lock recessed portion formed in the second lock-hole structural member 44. The first lock pin 26 (serving as a lock member) is operably installed in the large-diameter portion 15*e* of rotor 15 of vane rotor 9 such that movement of the first lock pin 26 into and out of engagement with the first lock hole 24 is permitted. The second lock pin 27 (serving as a lock member) is operably installed in the large-diameter portion 15*e* of rotor 15 of vane rotor 9 such that movement of the second lock pin 27 into and out of engagement with the second lock hole 25 is permitted. The second hydraulic circuit 6 is provided for disengagement of the first lock pin 26 from the first lock hole 24 and for disengagement of the second lock pin 27 from the second lock hole 25.

As shown in FIGS. 1, 2A, 3A-3B, and 7, the first retaining hole 41 (a stepped recessed portion) is formed at the innermost peripheral side of sprocket 1 and configured as a stepped groove constructed by a large-diameter bore 41*a* facing the rotor 15 and a small-diameter bore 41*b* of the bottom side (formed in a substantially center of the bottom face of large-diameter bore 41*a*).

Large-diameter bore 41*a* is formed into a substantially rectangular shape (a circumferentially-elongated groove). The radially inside opening end 41*c* of large-diameter bore 41*a* of first retaining hole 41, facing the central support bore 1*b* of sprocket 1, is opened into the central support bore 1*b*. The inner end face 41*d* (a flat surface) of large-diameter bore 41*a*, radially opposed to the inside opening end 41*c*, is formed into a flattened shape (a flat inner peripheral surface).

Small-diameter bore 41*b* is formed as a cylindrical bore closed at the bottom. The depth of small-diameter bore 41*b* is dimensioned to be slightly longer than the axial length of a small-diameter press-fit section 43*b* (see FIGS. 3A-3B) of the first lock-hole structural member 43.

The edge of the inner circumference of the stepped portion between large-diameter bore 41*a* and small-diameter bore 41*b* is formed as a tapered annular guide surface 41*e*.

Figure 7:
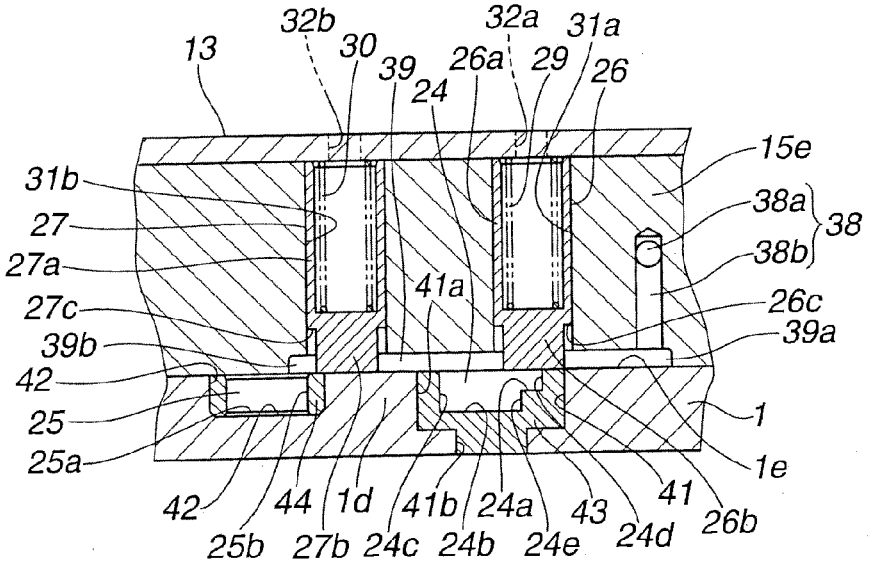
FIG. 7 is a sectional view taken along the line B-B of FIG. 4, showing operations of respective lock pins when the vane rotor has been held at the maximum phase-retard position.

The second retaining hole 42 is formed as a cylindrical bore having a circular lateral cross section in planar view (see FIG. 2A) and a comparatively shallow depth (see FIG. 7). The inside diameter of the second retaining hole 42 is dimensioned to be slightly less than the outside diameter of a press-fit section of the second lock-hole structural member 44.

Both of the first retaining hole 41 and the second retaining hole 42 are always sealed by the opposing side face of vane rotor 9 during rotation of vane rotor 9 relative to housing 7 (sprocket 1).

Figure 2A:
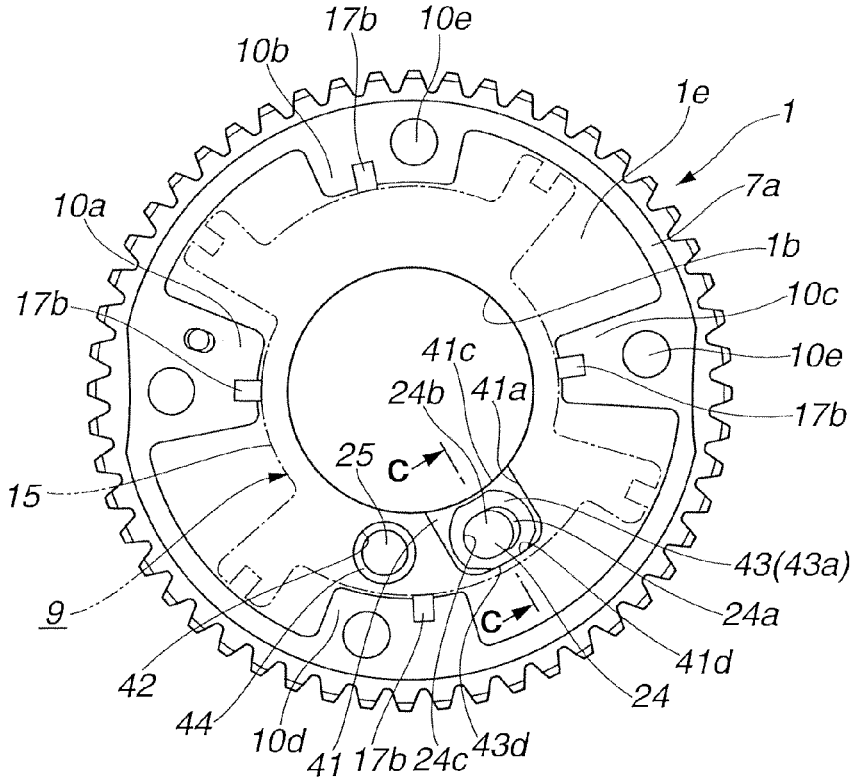
Figure 3A:
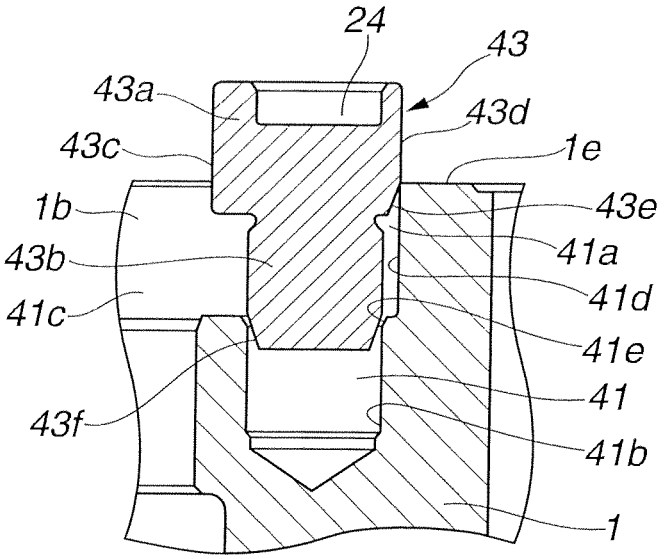
Figure 3B:
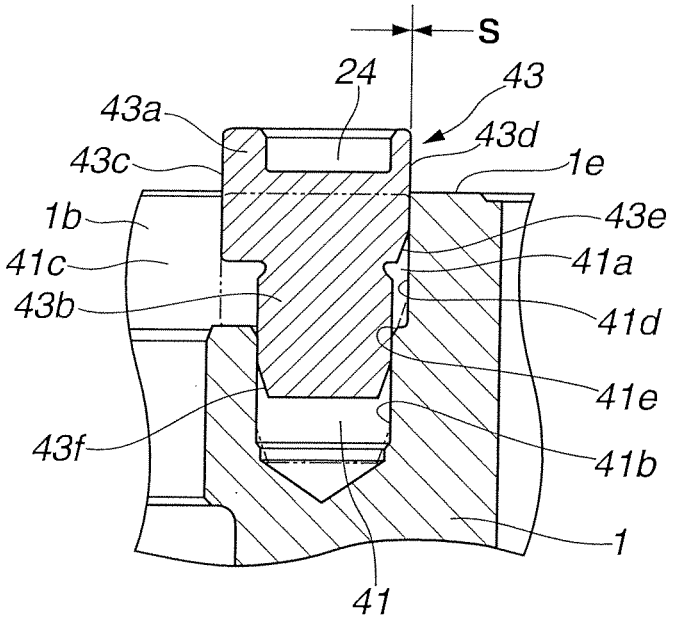
FIG. 3B is a sectional view taken along the line C-C of FIG. 2A, showing a state where the first lock-hole structural member begins to press-fit into the first retaining hole.

As shown in FIGS. 2A and 3A-3B, the first lock-hole structural member 43 is comprised of a lock-hole structural section 43*a* (a large-diameter head) configured to be retained in the large-diameter bore 41*a* of the first retaining hole 41, and the small-diameter press-fit section 43*b* protruding from the bottom face of the lock-hole structural section 43*a* and integrally formed as a protruding leg press-fitted into the small-diameter bore 41*b* of the first retaining hole 41.

Figure 2B:
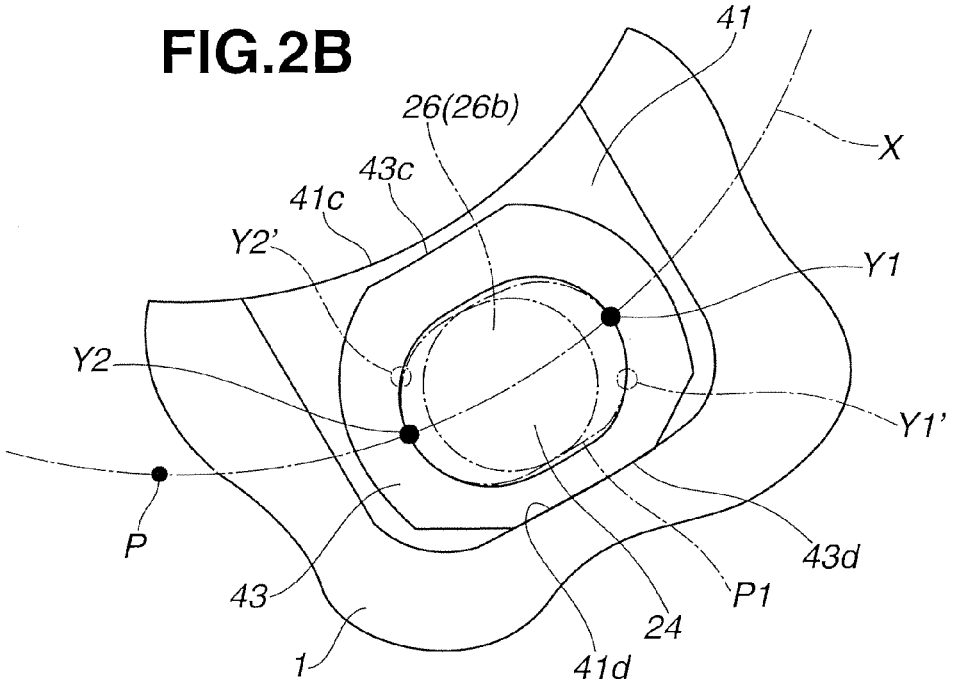
FIG. 2B is an explanatory view illustrating the orbit of a first lock pin with a first lock-pin structural member of the embodiment positioned in a rotation direction.

As best seen in FIGS. 2A-2B, the lock-hole structural section 43*a* is formed into an elliptic or oval shape and arranged along in the circumferential direction of sprocket 1. The central portion of the upside (the top end) of the lock-hole structural section 43*a* is formed as a circumferentially-elongated recessed groove, which serves as the first lock hole 24. The inner end face 43*c* of the lock-hole structural section 43*a* is located at the opening end 41*c* of large-diameter bore 41*a*, and cut straight without radially protruding into the central support bore 1*b*. In a similar manner, the outer end face 43*d* (a planar section) of the lock-hole structural section 43*a* is cut straight and configured parallel to the inner end face 43*c*, and formed into a flattened shape (a flat outer peripheral surface).

As appreciated from the cross section of FIG. 3B, when the first lock-hole structural member 43 is axially press-fitted into the first lock hole 24, the outer end face 43*d* is arranged to be opposed to the inner end face 41*d* of large-diameter bore 41*a* with a very small clearance space "S", so as to restrict a rotation position (a rotary motion) of the first lock-hole structural member 43.

The lower end (the lower edge) of the outer end face 43*d*, bordering on the small-diameter press-fit section 43*b*, is formed as a slightly tapered guide portion 43*e* (a chamfered portion) having a comparatively long axial length, thereby ensuring smooth insertion of the lock-hole structural section 43*a* (the large-diameter head) into the large-diameter bore 41*a*.

Small-diameter press-fit section 43*b* is formed into a cylindrical shaft shape. The outside diameter of small-diameter press-fit section 43*b* is dimensioned to be slightly greater than the inside diameter of small-diameter bore 41*b*, thereby ensuring a press-fit margin. The edge of the outer circumference of the lower end of small-diameter press-fit section 43*b* is formed as a tapered annular guide surface 43*f*, thereby ensuring a good press-fit performance.

As shown in FIGS. 7-10, the first lock hole 24 is formed as a two-stage stepped hole (a first lock guide groove) whose bottom face lowers stepwise from the phase-retard side to the phase-advance side, and configured or formed into an elliptic or oval shape extending in the circumferential direction of sprocket 1. Assuming that the inner face 1*e* of sprocket 1 is regarded as an uppermost level, the first lock guide groove (the two-stage stepped groove) is configured to gradually lower or deepen from the first bottom face 24*a* to the second bottom face 24*b*, in that order. Each of two inner faces 24*d*-24*e* (see FIG. 9) arranged on the phase-retard side and vertically extending from respective bottom faces 24*a*-24*b*, is formed as an upstanding wall surface. Also, an inner face 24*c* (see FIGS. 7-10) arranged on the phase-advance side and vertically extending from the second bottom face 24*b*, is formed as an upstanding wall surface. The area of the first bottom face 24*a* is dimensioned to be less than the area of the end face of the tip 26*b* of the first lock pin 26. In contrast, the second bottom face 24*b* is configured to slightly extend in the circumferential direction (in the phase-advance direction), such that the area of the second bottom face 24*b* is dimensioned to be greater than the area of the end face of the tip 26*b* of the first lock pin 26. Hence, the leftmost end (viewing FIGS. 7-10) of the second bottom face 24*b* is arranged at an intermediate position somewhat displaced toward the phase-advance side with respect to the maximum phase-retard angular position of vane rotor 9 on the inner face 1*e* of sprocket 1.

The second lock hole 25 is arranged on the same circle with the same center as the first lock hole 24, and configured as a cylindrical bore formed in the second lock-hole structural member 44. The bottom face 25*a* of the second lock hole 25 is formed as a flat face without any stepped portion. The bottom face 25*a* of the second lock hole 25 is arranged at the intermediate position somewhat displaced toward the phase-retard side with respect to the maximum phase-advance angular position of vane rotor 9 on the inner face 1*e* of sprocket 1. An inner face arranged on the phase-advance side and vertically extending from the second bottom face 25*a*, is formed as an upstanding wall surface. Also, an inner face 25*b* arranged on the phase-retard side and vertically extending from the second bottom face 25*a*, is formed as an upstanding wall surface. The outside diameter of the tip 27*b* of the second lock pin 27 is dimensioned to be less than the inside diameter of the second lock hole 25. Hence, even with the tip 27*b* of the second lock pin 27 brought into engagement with the second lock hole 25, a slight clearance space, created by the difference between the outside diameter and the inside diameter, permits a slight circumferential movement of the second lock pin 27 from the phase-retard side to the phase-advance side.

The first lock hole 24 and the second lock hole 25 are configured to also serve as unlocking pressure-receiving chambers into which working fluid (hydraulic pressure) is introduced from the second hydraulic circuit 6, such that the introduced hydraulic pressure simultaneously acts on a first stepped surface 26*c* (a pressure-receiving surface) of the first lock pin 26 and a second stepped surface 27*c* (a pressure-receiving surface) of the second lock pin 27 as well as the end faces of the tips of the first lock pin 26 and the second lock pin 27.

As best seen in FIGS. 1, and 7-11, the first lock pin 26 is contoured as a stepped shape, comprised of a lock-pin main body 26*a* slidably disposed in a first slide guide close-fitting bore (simply, a first slide bore) 31*a* formed in the large-diameter portion 15*e* of rotor 15 as an axial through hole extending along an axial direction of the camshaft 2, and a small-diameter axially-protruding tip 26*b*, and the first stepped surface 26*c* through which the lock-pin main body 26*a* and the small-diameter tip 26*b* are integrally formed with each other.

The first slide bore 31*a* is arranged on the inner peripheral side of the large-diameter portion 15*e* of rotor 15 in such a manner as to be conformable to the position of formation of the first lock hole 24.

The lock-pin main body 26*a* is formed as a right-circular cylindrical-hollow member, which is configured to be slidable in the first slide bore 31*a* in a fluid-tight fashion. Small-diameter tip 26*b* is formed into a substantially right-circular cylindrical shape. The outside diameter of small-diameter tip 26*b* is dimensioned to be less the inside diameter of the first lock hole 24.

The first lock pin 26 is permanently biased in a direction of movement of the first lock pin 26 into engagement with the first lock hole 24 by a spring force of a first spring 29 (a first biasing member). The first spring 29 is disposed between the bottom face of an axial spring bore formed in the lock-pin main body 26*a* in a manner so as to axially extend from the rear end face and the inner wall surface of front cover 13 under preload.

The first stepped surface 26*c* is formed into an annular shape, and functions as a pressure-receiving surface that receives hydraulic pressure introduced from a communicating passage 39 (described later). The first stepped surface 26*c* is configured to cause a backward movement of the first lock pin 26 out of engagement with the first lock hole 24 against the spring force of the first spring 29, thus unlocking a lock.

A first breather 32*a* (a through hole) is located at the upper end of the first slide bore 31*a* of the rotor large-diameter portion 15*e* and formed in the front plate 13 and configured to be opened to the atmosphere, thereby ensuring smooth sliding movement of the first lock pin 26.

As shown in FIGS. 5-8, when vane rotor 9 rotates relative to sprocket 1 from the maximum phase-retard position to the maximum phase-advance side, the tip 26*b* of the first lock pin 26 is brought into abutted-engagement with the first and second bottom faces 24*a*-24*b*, one-by-one (in a stepwise manner) and further moves in the phase-advance direction, while being kept in sliding-contact with the second bottom face 24*b*. Finally, the edge of the outer circumference of the tip 26*b* of the first lock pin 26 is brought into abutted-engagement with the inner face 24*c* of the phase-advance side, thereby restricting a further rotary motion of vane rotor 9 in the phase-advance direction. The details of the operation of the variable valve actuation apparatus (in particular, the operation of the position-hold mechanism) will be described later by the item [OPERATION OF EMBODIMENT].

The shape (i.e., the outside diameter, axial length, and the like) of the second lock pin 27 is similar to the first lock pin 26. The second lock pin 27 is comprised of a lock-pin main body 27*a* slidably disposed in a second slide guide close-fitting bore (simply, a second slide bore) 31*b* configured circumferentially side by side with the first slide bore 31*a* and formed in the large-diameter portion 15*e* of rotor 15 as an axial through hole, and a small-diameter axially-protruding tip 27*b*, and the second stepped surface 27*c* through which the lock-pin main body 27*a* and the small-diameter tip 27*b* are integrally formed with each other.

In a similar manner to the first slide bore 31*a*, the second slide bore 31*b* is arranged on the inner peripheral side of large-diameter portion 15*e* of rotor 15 in such a manner as to be conformable to the position of formation of the second lock hole 25.

The lock-pin main body 27*a* is formed as a right-circular cylindrical-hollow member, which is configured to be slidable in the second slide bore 31*b* in a fluid-tight fashion. Small-diameter tip 27*b* is formed into a substantially right-circular cylindrical shape. The outside diameter of small-diameter tip 27*b* is dimensioned to be less the inside diameter of the second lock hole 25.

The second lock pin 27 is permanently biased in a direction of movement of the second lock pin 27 into engagement with the second lock hole 25 by a spring force of a second spring 30 (a second biasing member). The second spring 30 is disposed between the bottom face of an axial spring bore formed in the lock-pin main body 27*a* in a manner so as to axially extend from the rear end face and the inner wall surface of front cover 13 under preload.

The second stepped surface 27*c* is formed into an annular shape, and functions as a pressure-receiving surface that receives hydraulic pressure introduced from the communicating passage 39 (described later). The second stepped surface 27*c* is configured to cause a backward movement of the second lock pin 27 out of engagement with the second lock hole 25 against the spring force of the second spring 30, thus unlocking a lock.

A second breather 32*b* (a through hole) is located at the upper end of the second slide bore 31*b* of the rotor large-diameter portion 15*e* and formed in the front plate 13 and configured to be opened to the atmosphere, thereby ensuring smooth sliding movement of the second lock pin 27.

As shown in FIGS. 7-10, when vane rotor 9 rotates relative to sprocket 1 from the maximum phase-retard position to the maximum phase-advance side, the tip 27*b* of the second lock pin 27 is brought into engagement with the second lock hole 26, while sliding on the inner face 1*e* of sprocket 1. Thus, the end face of the tip 27*b* is brought into elastic-contact with the bottom face 25*a* of the second lock hole 26. Thereafter, finally, the edge of the outer circumference of the tip 27*b* of the second lock pin 27 is brought into abutted-engagement with the inner face 25*b* of the phase-retard side, thereby restricting a rotary motion of vane rotor 9 in the phase-retard direction.

Figure 10:
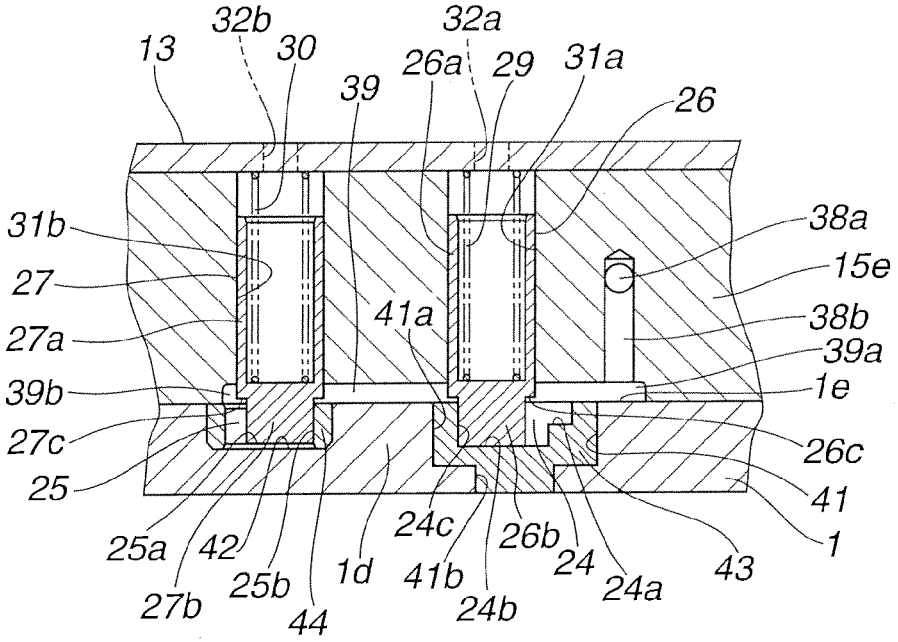
FIG. 10 is a sectional view taken along the line B-B of FIG. 4, showing operations of the respective lock pins when the vane rotor has been further rotated in the phase-advance direction from the angular position shown in FIG. 9, and reached the intermediate phase position.

As best seen in FIG. 10, at the intermediate phase position at which the second lock pin 27 has engaged with the second lock hole 25, the first lock pin 26 has also engaged with the first lock hole 24. At this time, the edge of the outer circumference of the tip 26*b* of the first lock pin 26 is brought into abutted-engagement with the inner face 24*c* of the phase-advance side. Under these conditions, the circumferentially-opposed outer peripheral edges of first and second lock pins 26-27, circumferentially opposed to each other, abut with the circumferentially-opposed upstanding inner faces 24*c* and 25*b* of first and second lock holes 24-25, respectively, such that the specified area (i.e., a partition wall section 1*d* defined between first and second lock holes 24-25) of the inner face 1*e* of sprocket 1, ranging between the two upstanding inner faces 24*c* and 25*b*, is sandwiched with the tips 26*b*-27*b* of two lock pins 26-27. Hence, a free rotary motion of vane rotor 9 to the phase-advance side or to the phase-retard side can be restricted.

Figure 11:
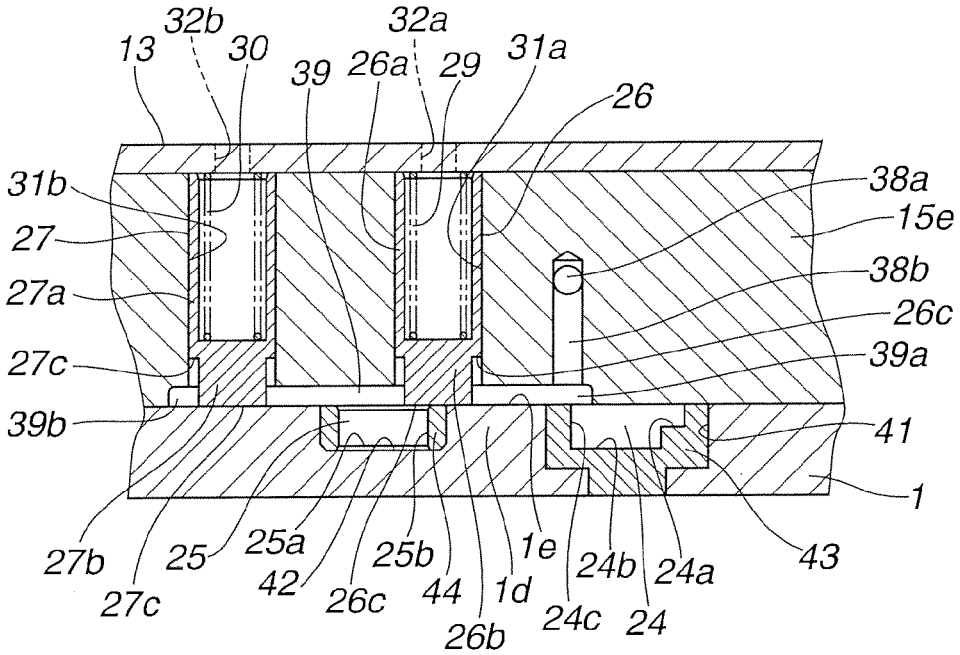
FIG. 11 is a sectional view taken along the line B-B of FIG. 4, showing operations of the respective lock pins when the vane rotor has been held at the maximum phase-advance position.

That is, by simultaneously engaging first and second lock pins 26-27 with respective lock holes 24-25, the angular phase of vane rotor 9 relative to housing 7 (sprocket 1) can be stably surely held or locked at the intermediate phase position (see FIG. 10) between the maximum phase-retard position (see FIG. 7) and the maximum phase-advance position (see FIG. 11).

By the way, as seen in FIG. 10, under a condition where first and second lock pins 26-27 have engaged with respective lock holes 24-25, the first stepped surface 26*c* and the second stepped surface 27*c* are configured to be positioned slightly upward as compared to a level of the edges of the upper ends of the lock holes 24-25.

Returning to FIG. 1, the second hydraulic circuit 6 includes a supply-and-exhaust passage 33 configured to supply working fluid (hydraulic pressure) to the first lock hole 24 and the second lock hole 25 through a supply passage 34 branched from the discharge passage 20*a* of oil pump 20, and to drain working fluid (hydraulic pressure) from the first lock hole 24 and the second lock hole 25 through an exhaust passage 35 communicating the drain passage 22, and a second electromagnetic directional control valve (a second control valve) 36. Second electromagnetic directional control valve 36 is provided for switching between fluid-communication between the supply-and-exhaust passage 33 and the supply passage 34 and fluid-communication between the supply-and-exhaust passage 33 and the exhaust passage 35, depending on an engine operating condition.

As shown in FIG. 1, one end of supply-and-exhaust passage 33 is connected to a port of the second electromagnetic directional control valve 36. The other end of supply-and-exhaust passage 33 is configured as an axially-extending but partly-radially-bent supply-and-exhaust passage portion 33*a* formed in the substantially cylindrical fluid-passage structural member 37. The supply-and-exhaust passage portion 33*a* is configured to communicate with the first lock hole 24 and the second lock hole 25 through an oil passage 38 and the communicating passage 39, both formed in the rotor 15.

Fluid-passage structural member 37 has a plurality of annular seal retaining grooves formed in its outer peripheral surface and axially spaced from each other. Three seal rings 40, 40, 40 are fitted into the respective annular seal retaining grooves for sealing the opening ends of phase-retard passage portion 18*a* and supply-and-exhaust passage portion 33*a* and one axial end of hydraulic chamber 19*b*.

As shown in FIGS. 4 and 7, oil passage 38 is constructed by a radial passage portion 38*a* bored along the radial direction of rotor 15 and an axial passage portion 38*b* bored along the axial direction of rotor 15 and connected to the radial passage portion 38*a* substantially at a midpoint of radial passage portion 38*a*. Radial passage portion 38*a* is formed as a through hole radially penetrating the large-diameter portion 15*e* of rotor 15 by drilling, and thereafter the opening end of the outer peripheral side of radial passage portion 38*a* is closed by a ball-shaped plug (not shown).

As shown in FIG. 4, communicating passage 39 is configured as a substantially circular-arc shaped recessed groove formed in the front end face of rotor 15. Regarding the position of formation of the communicating passage 39, the communicating passage 39 is formed at a position in close proximity to the inner peripheral surface of large-diameter portion 15*e* of rotor 15, that is, a position which is offset radially inward from the centers of the first lock hole 24 and the second lock hole 25 toward the rotation axis of rotor 15.

Additionally, the circumferential length of the circular-arc shaped communicating passage 39, ranging from one circumferential end 39*a* to the other circumferential end 39*b*, is dimensioned such that the circular-arc shaped communicating passage 39 always faces both the first lock hole 24 and the second lock hole 25 and thus the first lock hole 24 and the second lock hole 25 are always communicated with each other through the communicating passage 39, at any relative-rotation position of vane rotor 9 relative to housing 7. Also, as shown in FIGS. 7-11, the lower ends of the first slide bore 31*a* and the second slide bore 31*b* of the rotor large-diameter portion 15*e* are configured to face the communicating passage 39. In other words, the communicating passage 39 is configured to always communicate with first and second stepped surfaces 26*c*-27*c* and first and second lock holes 24-25 at any relative-rotation position of vane rotor 9 from the maximum phase-retard position (see FIG. 7) to the maximum phase-advance position (see FIG. 11). Also, the previously-mentioned one circumferential end 39*a* of communicating passage 39 is configured to communicate with the axial passage portion 38*b* of oil passage 38.

As appreciated from the system block diagram of FIG. 1, the second electromagnetic directional control valve 36 is a solenoid-actuated three-port, two-position, spring-offset ON-OFF valve. Second electromagnetic directional control valve 36 is configured to switch between fluid-communication between the supply-and-exhaust passage 33 and the supply passage 34 and fluid-communication between the supply-and-exhaust passage 33 and the exhaust passage 35, depending on a selected one of two axial positions of the valve spool, determined by a command signal (an ON (energizing) signal or an OFF (de-energizing) signal) from the electronic controller to the solenoid coil of second electromagnetic directional control valve 36 and the spring force of a valve spring.

When stopping the engine by turning an ignition switch OFF, a control current is outputted from the electronic controller to the first electromagnetic directional control valve 21 immediately before the engine has completely stopped rotating. Hence, the valve spool of first electromagnetic directional control valve 21 shifts to a given axial position, and whereby fluid-communication between the discharge passage 20*a* and one of phase-retard hydraulic passage 18 and phase-advance hydraulic passage 19 is established, while fluid-communication between the drain passage 22 and the other of phase-retard hydraulic passage 18 and phase-advance hydraulic passage 19 is established. That is, the electronic controller detects the current relative-rotation position of vane rotor 9 to housing 7 based on latest up-to-date informational data signals from the cam angle sensor and the crank angle sensor, so as to supply hydraulic pressure to either each individual phase-retard hydraulic chamber 11 or each individual phase-advance hydraulic chamber 12 depending on the detected relative-rotation position of vane rotor 9. As a result of this, the angular phase of vane rotor 9 is shifted or controlled to the predetermined intermediate phase position (see FIG. 4) between the maximum phase-retard position and the maximum phase-advance position.

At the same time, the second electromagnetic directional control valve 36 becomes energized, and thus fluid-communication between the supply-and-exhaust passage 33 and the exhaust passage 35 becomes established. As a result of this, working fluid in first and second lock holes 24-25 flows from the supply-and-exhaust passage 33 through the communicating passage 39 and the oil passage 38 into the exhaust passage 35 and the drain passage 22, and then drained into the oil pan 23. Hydraulic pressure in first and second lock holes 24-25 (i.e., the unlocking pressure-receiving chambers) becomes low. Hence, by the spring forces of springs 29-30, advancing-movement of first and second lock pins 26-27 into engagement with respective lock holes 24-25 occurs (see FIG. 10). As a result, first and second lock pins 26-27 become engaged with respective lock holes 24-25.

Under these conditions, on one hand, the edge of the outer circumference of the tip 26*b* of the first lock pin 26 is brought into abutted-engagement with the first-lock-hole inner face 24*c* of the phase-advance side, thereby restricting an angular displacement (a rotary motion) of vane rotor 9 in the phase-advance direction. On the other hand, the edge of the outer circumference of the tip 27*b* of the second lock pin 27 is brought into abutted-engagement with the second-lock-hole inner face 25*b* of the phase-retard side, thereby restricting an angular displacement (a rotary motion) of vane rotor 9 in the phase-retard direction. In this manner, as shown in FIG. 4, vane rotor 9 is held at the intermediate phase position, and thus intake valve closure timing (IVC) is controlled to a somewhat phase-advanced timing value before a piston bottom dead center (BBDC).

Therefore, when restarting the engine from cold after lapse of long time, due to the specific intake valve closure timing (IVC) as discussed previously, an effective engine compression ratio is enhanced, thereby ensuring a good combustion, that is, an improved stability in engine-start and a good startability.

After this, when the operating condition of the engine shifts to an idling condition, the first electromagnetic directional control valve 21 is operated responsively to a control current outputted from the electronic controller so as to establish fluid-communication between the discharge passage 20*a* and the phase-retard hydraulic passage 18 and fluid-communication between the drain passage 22 and the phase-advance hydraulic passage 19 (see the flow path configuration of first electromagnetic directional control valve 21 shown in FIG. 1). At this time, responsively to an OFF (de-energizing) signal) from the electronic controller, the second electromagnetic directional control valve 36 becomes de-energized such that fluid-communication between the supply-and-exhaust passage 33 and the supply passage 34 is established and fluid-communication between the supply-and-exhaust passage 33 and the exhaust passage 35 is blocked.

As a result of this, hydraulic pressure (working fluid), discharged from the oil pump 20 into the discharge passage 20*a*, flows through the supply passage 34, the supply-and-exhaust passage 33 and the oil passage 38 into the communicating passage 39. Hydraulic pressure (working fluid), introduced into the communicating passage 39, further flows into each of first and second lock holes 24-25.

Accordingly, the hydraulic pressure acts on the first stepped surface 26*c* (the pressure-receiving surface) of the first lock pin 26 and the second stepped surface 27*c* (the pressure-receiving surface) of the second lock pin 27. Hence, first and second lock pins 26-27 begin to move backward against the spring forces of springs 29-30. That is, retreating-movement of the tip 26*b* of the first lock pin 26 out of engagement with the first lock hole 24 and retreating-movement of the tip 27*b* of the second lock pin 27 out of engagement with the second lock hole 25 occur simultaneously, so as to unlock a lock. As a result of this, a free rotary motion of vane rotor 9 can be ensured or permitted.

Part of hydraulic pressure (working fluid), discharged into the discharge passage 20*a*, is supplied through the phase-retard hydraulic passage 18 (the phase-retard passage portion 18*a*) and each of the first communication holes 11*a* to each individual phase-retard hydraulic chamber 11. On the other hand, working fluid in each individual phase-advance hydraulic chamber 12 is drained through each of the second communication holes 12*a* and the phase-advance passage 19 (the phase-advance passage portion 19*a*) via the drain passage 22 into the oil pan 23.

Therefore, hydraulic pressure in each phase-retard hydraulic chamber 11 becomes high, while hydraulic pressure in each phase-advance hydraulic chamber 12 becomes low. Hence, as shown in FIG. 5, vane rotor 9 rotates in the phase-retard direction (anticlockwise), such that one side face (the anticlockwise side face 16*e*, viewing FIG. 5) of the first vane 16*a* is brought into abutted-engagement with the radially-inward protruding surface formed on one side face (the clockwise side face, viewing FIG. 5) of the opposed first shoe 10*a*, and thus vane rotor 9 is held at the maximum phase-retard position.

As a result of this, a valve overlap of open periods of intake and exhaust valves becomes zero, and thus it is possible to suppress the occurrence of blow-back gas flow from one of intake and exhaust ports via the combustion chamber to the other port, thereby ensuring a good combustion and consequently ensuring improved fuel economy and stable engine revolutions.

Also, when the engine operating condition has been shifted to a high-speed high-load operating range, the first electromagnetic directional control valve 21 is operated responsively to a control current outputted from the electronic controller so as to establish fluid-communication between the discharge passage 20*a* and the phase-advance hydraulic passage 19 and fluid-communication between the drain passage 22 and the phase-retard hydraulic passage 18. At this time, the de-energized state of second electromagnetic directional control valve 36 is still continued, such that fluid-communication between the supply-and-exhaust passage 33 and the supply passage 34 is established and fluid-communication between the supply-and-exhaust passage 33 and the exhaust passage 35 is blocked.

Therefore, hydraulic pressure in each phase-advance hydraulic chamber 12 becomes high, while hydraulic pressure in each phase-retard hydraulic chamber 11 becomes low. Hence, as shown in FIG. 6, vane rotor 9 rotates in the phase-advance direction (clockwise), such that the other side face (the clockwise side face, viewing FIG. 6) of the first vane 16*a* is brought into abutted-engagement with the radially-inward protruding surface formed on one side face (the anticlockwise side face, viewing FIG. 6) of the opposed second shoe 10*b*, and thus vane rotor 9 is held at the maximum phase-advance position.

As a result of this, intake valve open timing (IVO) becomes phase-advanced and hence a valve overlap of open periods of intake and exhaust valves becomes large and thus the intake-air charging efficiency is increased, thereby improving engine torque output.

By the way, when the ignition switch has been turned OFF for stopping the engine, suppose that vane rotor 9 have not returned to the intermediate phase position between the maximum phase-retard position and the maximum phase-advance position due to some kind of causes. For instance, assume that the angular position of vane rotor 9 relative to housing 7 has stopped at the maximum phase-retard position shown in FIGS. 5 and 7. In such a situation, when restarting the engine, the variable valve actuation device of the embodiment operates as follows.

Figure 8:
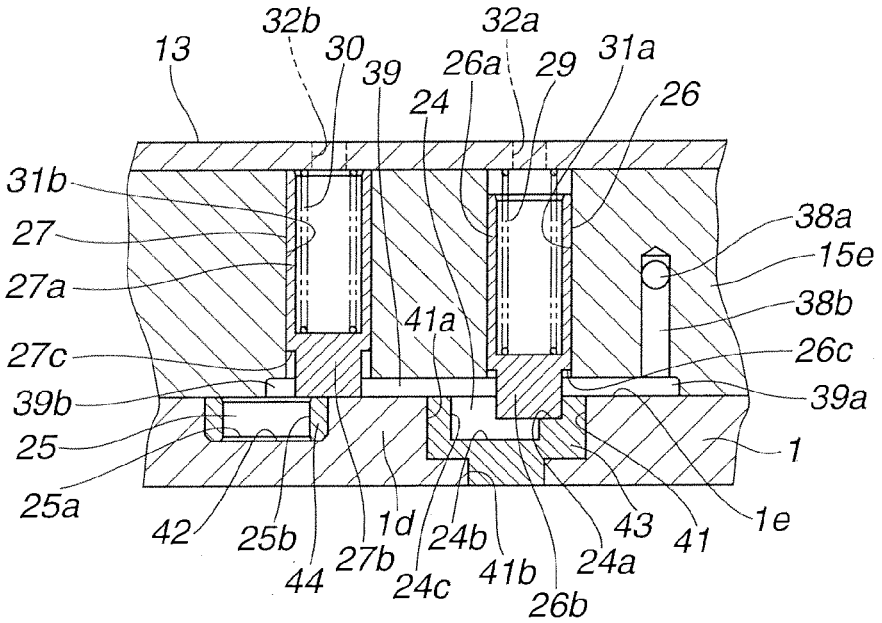
FIG. 8 is a sectional view taken along the line B-B of FIG. 4, showing operations of the respective lock pins when the vane rotor has been slightly rotated in the phase-advance direction from the maximum phase-retard position.

That is, when cranking operation starts by turning the ignition switch ON, at the initial stage of cranking, positive and negative alternating torque, caused by spring forces of engine valve springs, is inputted to the camshaft 2 (vane rotor 9). Owing to a negative torque input of alternating torque to the camshaft 2, vane rotor 9 tends to slightly rotate toward the phase-advance side. Thus, as shown in FIG. 8, the tip 26*b* of the first lock pin 26 lowers toward the first bottom face 24*a* of the first lock hole 24 by the spring force of the first spring 29, and then brought into abutted-engagement with the first bottom face 24*a*.

Figure 9:
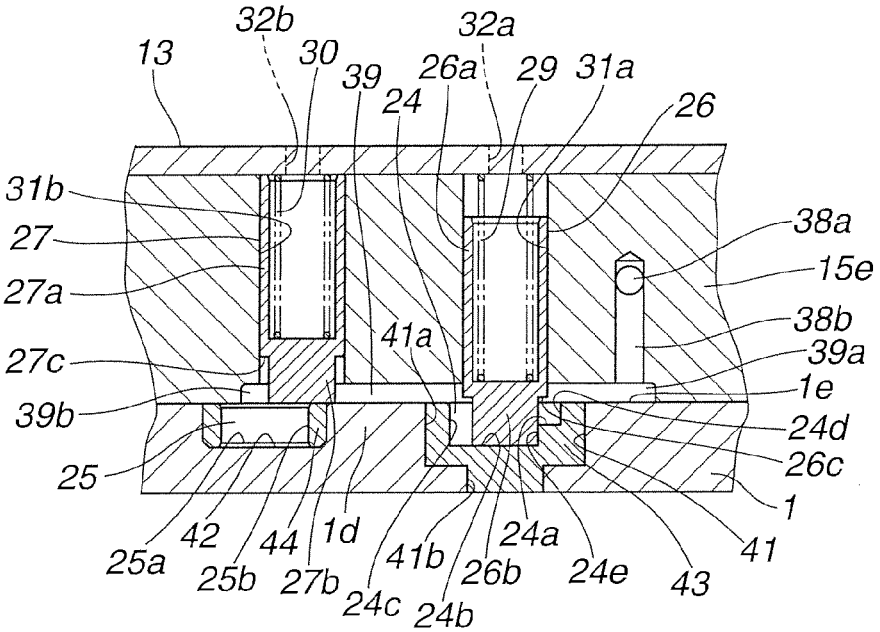
FIG. 9 is a sectional view taken along the line B-B of FIG. 4, showing operations of the respective lock pins when the vane rotor has been further rotated in the phase-advance direction from the angular position shown in FIG. 8.

When vane rotor 9 is forced toward the phase-retard side owing to a positive torque input to the camshaft 2 immediately after the negative torque input, the edge of the outer circumference of the tip 26*b* of the first lock pin 26 is brought into abutted-engagement with the upstanding inner face 24*d* vertically extending from the first bottom face 24*a* and arranged on the phase-retard side such that a rotary motion of vane rotor 9 to the phase-retard side is restricted. Thereafter, when a negative torque acts on the camshaft 2 again, owing to a rotary motion of vane rotor 9 to the phase-advance side, as shown in FIG. 9, the tip 26*b* of the first lock pin 26 further moves downward by the spring force of the first spring 29, and then brought into abutted-engagement with the second bottom face 24*b*.

Thereafter, when a positive torque acts on the camshaft 2 again, the edge of the outer circumference of the tip 26*b* of the first lock pin 26 is brought into abutted-engagement with the upstanding inner face 24*e* vertically extending from the second bottom face 24*b* and arranged on the phase-retard side such that a rotary motion of vane rotor 9 to the phase-retard side is restricted. That is, by virtue of a ratchet structure (i.e., a ratchet action) provided by the first lock pin 26 and the first lock hole 24 (the two-stage stepped hole), normal rotation of vane rotor 9 relative to sprocket 1 (housing 7) in the phase-advance direction is permitted, but reverse-rotation (counter-rotation) of vane rotor 9 relative to sprocket 1 in the phase-retard direction is restricted. Briefly speaking, by virtue of such a ratchet function, vane rotor 9 can be automatically rotated toward the phase-advance side with abutted-engagement of the tip 26*b* of the first lock pin 26 with the first and second bottom faces 24*a*-24*b*, one-by-one (in a stepwise manner).

Subsequently to the above, when owing to a negative torque input of alternating torque to the camshaft 2, vane rotor 9 further rotates toward the phase-advance side, as shown in FIG. 10, the edge of the outer circumference of the tip 26*b* of the first lock pin 26 is brought into abutted-engagement with the upstanding inner face 24*c* of the phase-advance side, while the end face of the tip 26*h* of the first lock pin 26 slides on the second bottom face 24*b* of the first lock hole 24 in the phase-advance direction. At the same time, the second lock pin 27 is brought into engagement with the second lock hole 25 and then the tip 27*b* is brought into abutted-engagement with the bottom face 25*a*, and simultaneously the edge of the outer circumference of the tip 27*b* of the second lock pin 27 is brought into abutted-engagement with the upstanding inner face 25*b* of the phase-retard side. As a result of this, the partition wall section 1*d* defined between first and second lock holes 24-25 and ranging between the two upstanding inner faces 24*c* and 25*b*, is sandwiched with the tips 26*b*-27*b* of two lock pins 26-27. Therefore, vane rotor 9 is automatically held at the intermediate phase position between the maximum phase-retard position and the maximum phase-advance position and additionally a free rotary motion of vane rotor 9 to the phase-advance side or to the phase-retard side can be restricted.

Accordingly, during normal cold-start operation, an effective compression ratio during engine cranking can be enhanced, thereby ensuring a good combustion, that is, an improved stability in engine-start and a good startability.

In the shown embodiment, when fixing the first lock-hole structural member 43 into the first retaining hole 41, first of all, as shown in FIG. 3A, the tapered guide portion 43*e* is brought into abutted-engagement with the upper edge of the inner end face 41*d* of large-diameter bore 41*a*, while the outer end face 43*d* (a planar section) of the lock-hole structural section 43*a* is arranged to be opposed to the inner end face 41*d* (a flat surface) of large-diameter bore 41*a*.

That is, when the first lock-hole structural member 43 is urged or moved downward after the outer end face 43*d* has been precisely located to face the inner end face 41*d*, there is a possibility that the lower edge of the outer end face 43*d* runs on the upper edge of the inner end face 41*d*, because of the previously-discussed very small clearance space "S", by which the inner end face 41*d* and the outer end face 43*d* are spaced apart from each other. The formation of tapered guide portion 43*e* avoids the lower edge of the outer end face 43*d* from running on the upper edge of the inner end face 41*d*. This ensures easy press-fitting work of the first lock-hole structural member 43 into the first retaining hole 41.

Thereafter, as shown in FIG. 3B, when the first lock-hole structural member 43 is pushed into the first retaining hole 41, guiding via the tapered guide portion 43*e*, the small-diameter press-fit section 43*b* is smoothly press-fitted into the small-diameter bore 41*b*, while the tapered annular guide surface 43*f* of the outer circumference of the lower end of small-diameter press-fit section 43*b* is guided by the tapered annular guide surface 41*e* of small-diameter bore 41*b*. Simultaneously, the outer end face 43*d* of lock-hole structural section 43*a* moves downward, while keeping sliding-contact with the inner end face 41*d* of large-diameter bore 41*a*. In the case of a unique press-fit structure of the shown embodiment, after the tapered guide portion 43*e* has been completely inserted into the large-diameter bore 41*a*, passing the upper edge of the inner end face 41*d* throughout its entire length, the small-diameter press-fit section 43*b* is press-fitted into the small diameter bore 41*b*. Hence, it is possible to suppress the lower edge of the outer end face 43*d* from running on the upper edge of the inner end face 41*d* of the first retaining hole 41.

Accordingly, as appreciated from the two-dotted line of FIG. 3B, the small-diameter press-fit section 43*b* of the first lock-hole structural member 43 is smoothly reliably fixed and press-fitted into the small-diameter bore 41*b* of the first retaining hole 41, while the first lock-hole structural member 43 is precisely positioned or located in its rotation direction by abutment between the inner end face 41*d* (a flat surface) and the outer end face 43*d* (a planar section).

As discussed previously, when the first lock-hole structural member 43 is press-fitted into the first retaining hole 41, positioning of the first lock-hole structural member 43 in its rotation direction can be made by abutment of the outer end face 43*d* of lock-hole structural section 43*a* with the inner end face 41*d* of large-diameter bore 41*a*. Hence, as shown in FIG. 2B, the axis "P" of the tip 26*b* of the first lock pin 26, which rotates together with relative rotation of vane rotor 9 to housing 7, can pass along a given orbit "X" of rotation of vane rotor 9.

That is, the orbit of the outside diameter of the tip 26*b* of the first lock pin 26 with respect to the first lock hole 24 moves along the given orbit "X", such that the outer periphery of the tip 26*b* is brought into contact with the first lock-hole structural member 43 at a phase-retard side contact point "Y1" on the given orbit "X" with rotary motion of vane rotor 9 in the phase-retard direction, and that the outer periphery of the tip 26*b* is brought into contact with the first lock-hole structural member 43 at a phase-advance side contact point "Y2" on the given orbit "X" with rotary motion of vane rotor 9 in the phase-advance direction.

However, when the first lock-hole structural member 43 is actually press-fitted into the first retaining hole 41, individual differences of the angular position of the first lock-hole structural member 43 in its rotation direction with respect to the first retaining hole 41 often occur.

Due to such individual positioning differences of the first lock-hole structural member 43 with respect to the first retaining hole 41, a phase-retard side contact point "Y1'" and a phase-advance side contact point "Y2'" tend to remarkably deviate from the given orbit "X" of rotation of vane rotor 9 as indicated by the one-dotted line of FIG. 2B. Due to the contact points "Y1'" and "Y2'" both deviated from the given orbit "X" of rotation of vane rotor 9, the relative-rotation position of vane rotor 9 to housing 7 (sprocket 1), as shown in FIGS. 7-9 for instance, tends to fluctuate undesirably.

In contrast, in the shown embodiment, the first lock-hole structural member 43 is precisely positioned or located in its rotation direction with respect to the first retaining hole 41 by abutment between the inner end face 41*d* (a flat surface) and the outer end face 43*d* (a planar section) as previously discussed. The axis "P" of the tip 26*b* of the first lock pin 26 can pass along the given orbit "X" of rotation of vane rotor 9. Hence, it is possible to suppress such undesirable fluctuations in the relative-rotation position of vane rotor 9 to housing 7 from occurring.

Additionally, positioning of the first lock-hole structural member 43 in its rotation direction with respect to the first retaining hole 41 can be automatically made, during press-fitting. This eliminates the necessity of having a high positioning accuracy press-fitting equipment. Hence, it is possible to ensure enhanced assembling efficiency and reduced manufacturing costs.

Also, the depth of the large-diameter bore 41*a* of the first retaining hole 41 is dimensioned to be longer than the axial length of the first lock-hole structural member 43 from the uppermost end (viewing FIG. 3A) of the tapered guide portion 43*e* to the lowermost end of the effective press-fit part of small-diameter press-fit section 43*b*. Hence, the outer end face 43*d* of lock-hole structural section 43*a* is brought into abutted-engagement with the inner end face 41*d* of large-diameter bore 41*a* before the small-diameter press-fit section 43*b* is brought into press-fit with the small-diameter bore 41*b*. This ensures a more smooth insertion of the first lock-hole structural member 43 into the first retaining hole 41.

By the way, in the shown embodiment, the inner end face 41*d* (a flat surface) and the outer end face 43*d* (a planar section) are both formed flat, for the purpose of precise positioning of the first lock-hole structural member 43 in its rotation direction with respect to the first retaining hole 41. Instead of using the two opposing (abutting) flat surfaces, for precise positioning, each of the inner end face 41*d* and the outer end face 43*d*, opposed to each other, may be formed as an non-circular curved surface, such as a segmental curved surface of an elliptic or oval shape.

On the other hand, the second lock-hole structural member 44 is forced into the second retaining hole 42 through the upper opening end of the second retaining hole 42, and fixed and directly press-fitted into the second retaining hole 42.

Additionally, in the shown embodiment, the radially inside opening end 41*c* of the large-diameter bore 41*a* of the first retaining hole 41 is configured to face the central support bore 1*b* of sprocket 1 so as to be opened into the central support bore 1*b* as a stepped recess. In other words, the first retaining hole 41 is formed at the innermost peripheral side of sprocket 1. Hence, the opening end of the first lock hole 24 and the clearance space between the first retaining hole 41 and the first lock-hole structural member 43 can be laid out close to the inner peripheral side of sprocket 1 as much as possible. Accordingly, it is possible to sufficiently reduce the outside diameter of vane rotor 9 whose one side face seals the opening end of the first lock hole 24 and the aforementioned clearance space in a fluid-tight fashion.

As a result, it is possible to decrease the total size of the variable valve actuation apparatus (the VTC device), while ensuring a good sealing action, i.e., a satisfactory seal performance of the circumference of the first lock hole 24.

Furthermore, in the shown embodiment, the first stepped surface 26*c* of the tip 26*b* of the first lock pin 26 and the second stepped surface 27*c* of the tip 27*b* of the second lock pin 27 are configured to also serve as unlocking pressure-receiving surfaces. The outer peripheral surfaces of the first lock-pin main body 26*a* and the second lock-pin main body 27*a* can be formed as right-circular cylindrical surfaces, respectively. Hence, it is possible to reduce the outside diameter of each of lock pins 26-27 as much as possible, thus ensuring the compact VTC device including the rotor 15, consequently allowing the excellent mountability of the VTC device on the engine.

Moreover, the communicating passage 39 is configured to always communicate with first and second lock holes 24-25 and first and second stepped surfaces 26*c*-27*c* at any relative-rotation position of vane rotor 9 relative to housing 7 (sprocket 1). Hence, hydraulic pressure, introduced from the oil pump 20 through the supply-and-exhaust passage 33 into the communicating passage 39, always acts on the stepped surfaces 26*c*-27*c*, and always acts on the end faces of the tips 26*b*-27*b* of lock pins 26-27 through the lock holes 24-25.

In this manner, the circumferential length of the circular-arc shaped communicating passage 39 is dimensioned such that the circular-arc shaped communicating passage 39 always faces both the first lock hole 24 and the second lock hole 25 and thus lock holes 24-25 are always communicated with each other through the communicating passage 39, at any relative-rotation position of vane rotor 9. Hence, there is a less volume change in the entire fluid passage from the supply-and-exhaust passage 33 to each of lock holes 24-25, thus suppressing an instantaneous hydraulic pressure drop. This avoids undesirable movement of first and second lock pins 26-27 into engagement with respective lock holes 24-25. As a result, a free rotary motion of vane rotor 9 to the phase-retard side or to the phase-advance side cannot be obstructed, thereby ensuring a smooth phase change (a smooth phase conversion) of vane rotor 9 relative to housing 7, that is, an improved responsiveness of phase change of vane rotor 9.

Additionally, in the intermediate phase hold state, the edge of the outer circumference of the tip 26*b* of the first lock pin 26 is kept in abutted-engagement with the upstanding inner face 24*c* of the phase-advance side of the first lock hole 24 so as to restrict a rotary motion of vane rotor 9 in the phase-advance direction. Simultaneously, the edge of the outer circumference of the tip 27*b* of the second lock pin 27 is kept in abutted-engagement with the upstanding inner face 25*b* of the phase-retard side of the second lock hole 25 so as to restrict a rotary motion of vane rotor 9 in the phase-retard direction. In this manner, in the intermediate phase hold state, the tips 26*b*-27*b* of first and second lock pins 26-27 are arranged to abut with the two adjacent upstanding inner faces 24*c* and 25*b* of first and second lock holes 24-25. In other words, in the intermediate phase hold state, two lock holes 24-25 can be laid out to be circumferentially spaced apart from each other as much as possible. Hence, it is possible to increase the thickness of the partition wall section 1*d* defined between first and second lock holes 24-25 as much as possible. Accordingly, it is possible to ensure a high mechanical strength of the VTC device including the sprocket 1 in which lock holes 24-25 are formed with first and second lock-hole structural members 43-44, thus avoiding or reducing a limitation on layout.

Additionally, the opening end of phase-retard passage portion 18*a* and the opening end of phase-advance passage portion 19*a* are not arranged adjacent to each other, but spaced enough, thus reducing the influence of pulsations of working fluid supplied to these passage portions. As a result, it is possible to reduce the number of seal rings 40 provided for sealing these opening ends.

Furthermore, the axial passage portion 38*b* is formed or bored in a part of rotor 15, which does not affect machining of vane rotor 9, thus suppressing a reduction in the workability (the machinability) for the vane rotor 9.

[Second Embodiment]

Figure 12:
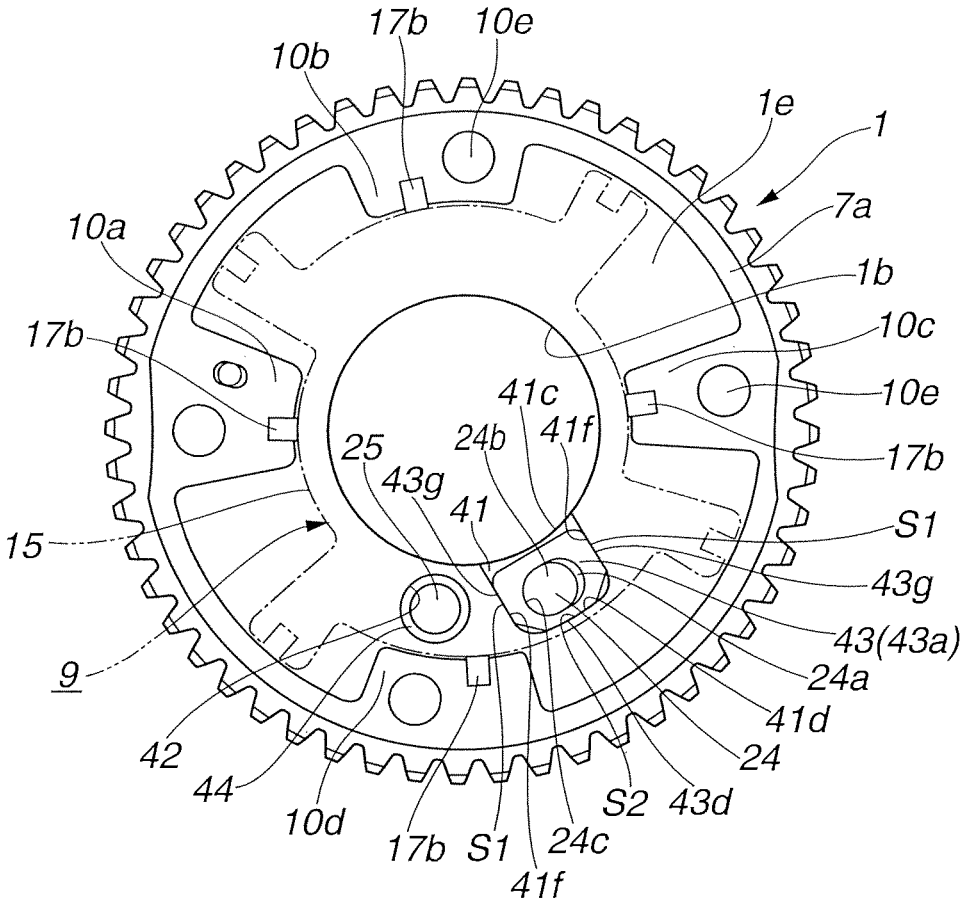
FIG. 12 is a sectional view taken along the line A-A of FIG. 1, showing a second embodiment of the VTC device according to the invention.

Referring now to FIG. 12, there is shown the lateral cross section of the variable valve actuation apparatus (the VTC device) of the second embodiment, taken along the line A-A of FIG. 1. The fundamental configuration of the second embodiment is similar to the first embodiment. The shape (in particular, the contour) of the lock-hole structural section 43*a* (the large-diameter head) of the first lock-hole structural member 43 of the second embodiment differs from that of the first embodiment.

That is, the lock-hole structural section 43*a* is shaped into a circumferentially-elongated substantially rectangular shape in planar view. Two parallel flat side faces 43*g*, 43*g* (both outside faces) of lock-hole structural section 43*a* are formed as width across flats, and arranged to be opposed to each other in the circumferential direction of sprocket 1. These flat both side faces 43*g*, 43*g* are arranged to be opposed to two opposing parallel flat side faces 41*f*, 41*f* (both inside faces) of the large-diameter bore 41*a* of the first retaining hole 41 with very small clearance spaces "S1", "S1", respectively. Hence, in the second embodiment, the first lock-hole structural member 43 is precisely positioned or located in its rotation direction with respect to the first retaining hole 41 by a first abutment pair (i.e., one of flat both side faces 43*g*, 43*g* and one of flat both side faces 41*f*, 41*f*) and by a second abutment pair (i.e., the other of flat both side faces 43*g*, 43*g* and the other of flat both side faces 41*f*, 41*f*).

By the way, two circumferentially-spaced edges of both side faces 43*g*, 43*g* of lock-hole structural section 43*a*, facing the inner end face 41*d* of the first retaining hole 41, are cut into a triangle. Additionally, in the second embodiment, the outer end face 43*d* of lock-hole structural section 43*a* is radially spaced apart from the inner end face 41*d* of large-diameter bore 41*a* with a comparatively large clearance space "S2".

Hence, in the second embodiment, after the first lock-hole structural member 43 has been press-fitted into the first retaining hole 41, a free rotary motion of the first lock-hole structural member 43 with respect to the first retaining hole 41 can be certainly restricted by abutted-engagement of flat both side faces 43*g*, 43*g* of lock-hole structural section 43*a* with flat both side faces 41*f*, 41*f* of large-diameter bore 41*a*. Accordingly, the VTC device of the second embodiment can provide almost the same operation and effects as the first embodiment.

[Third Embodiment]

Figure 13:
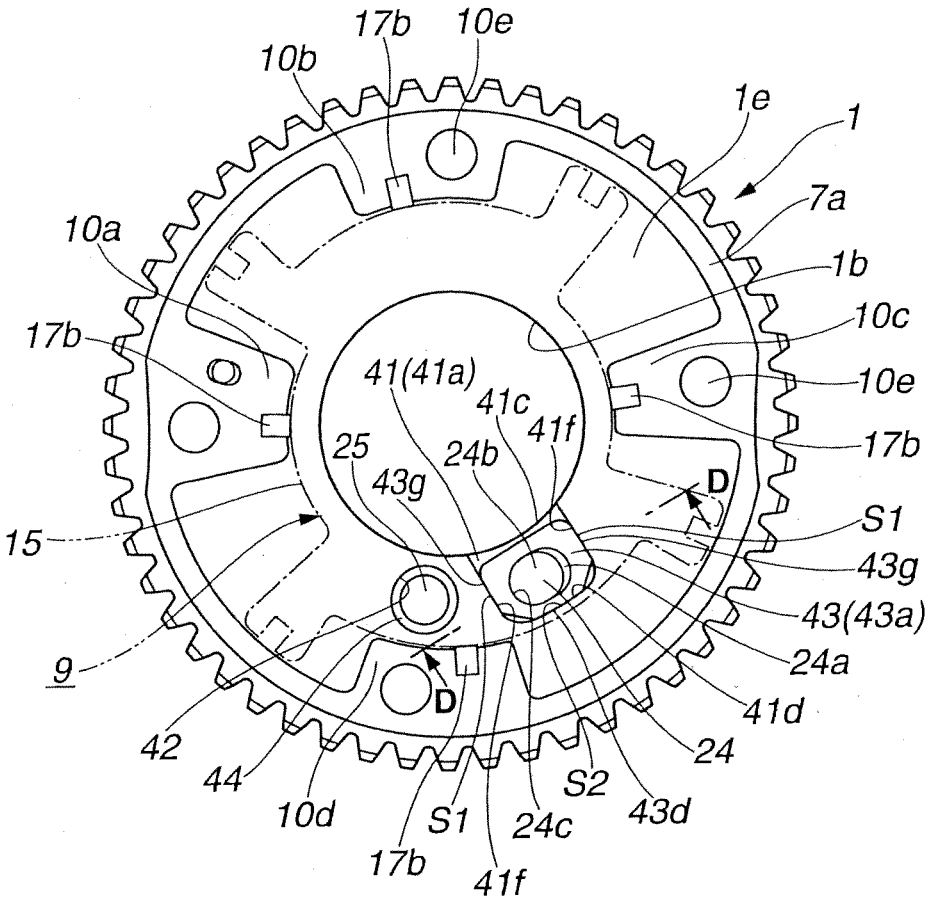
FIG. 13 is a sectional view taken along the line A-A of FIG. 1, showing a third embodiment of the VTC device according to the invention.
Figure 14:
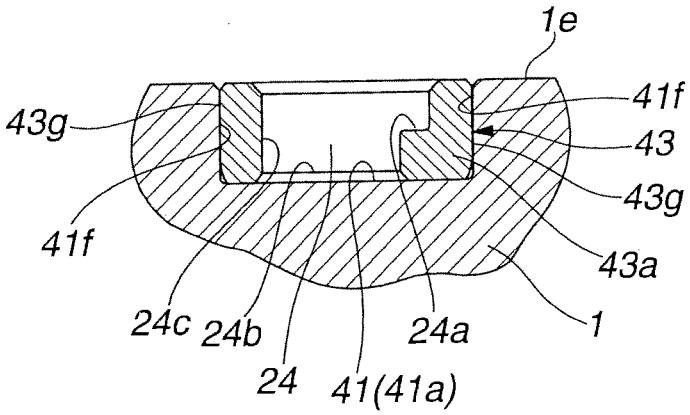
FIG. 14 is a sectional view taken along the line D-D of FIG. 13.

Referring now to FIGS. 13-14, there is shown the variable valve actuation apparatus (the VTC device) of the third embodiment. As best seen from the cross section of FIG. 14, the lock-hole structural section 43*a* of the first lock-hole structural member 43 is forced into the first retaining hole 41 through the upper opening of the first retaining hole 41, and fixed and directly press-fitted into the first retaining hole 41.

In more detail, the third embodiment differs from the first embodiment, in that, in the third embodiment the small-diameter bore 41*b* and the small-diameter press-fit section 43*b* are eliminated, but the contour of lock-hole structural section 43*a* of the third embodiment is similar to that of the second embodiment. That is, the lock-hole structural section 43*a* is shaped into a circumferentially-elongated substantially rectangular shape in planar view (see FIG. 13), and two parallel flat side faces 43*g*, 43*g* of lock-hole structural section 43*a* are formed as width across flats, and arranged to be opposed to each other in the circumferential direction of sprocket 1. In the third embodiment, these flat both side faces 43*g*, 43*g* are directly press-fitted and fixed to the circumferentially-opposed two parallel flat side faces 41*f*, 41*f* of the large-diameter bore 41*a* of the first retaining hole 41.

Accordingly, the VTC device of the third embodiment can provide almost the same operation and effects as the second embodiment. In particular, in the third embodiment, simultaneously with the press-fitting work of the lock-hole structural section 43*a* of the first lock-hole structural member 43 into the large-diameter bore 41*a* of the first retaining hole 41, precise positioning and fixing of the first lock-hole structural member 43 in its rotation direction with respect to the first retaining hole 41 can be achieved. Thus, it is possible to improve the work ability and assembling efficiency.

Additionally, as appreciated from the cross section of FIG. 14, axial lengths of the first retaining hole 41 and the first lock-hole structural member 43 can be designed or dimensioned sufficiently short, thus more greatly improving the press-fit workability.

[Fourth Embodiment]

Figure 15:
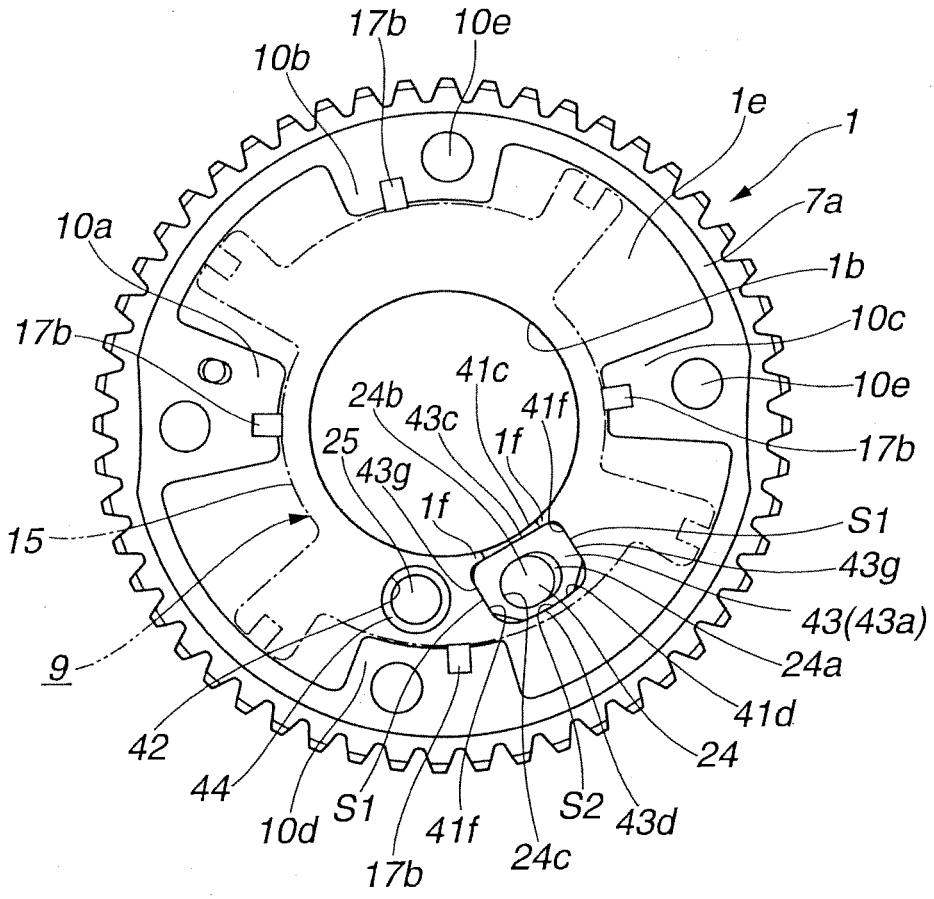
FIG. 15 is a sectional view taken along the line A-A of FIG. 1, showing a fourth embodiment of the VTC device according to the invention.

Referring now to FIG. 15, there is shown the variable valve actuation apparatus (the VTC device) of the fourth embodiment. The fundamental configuration of the fourth embodiment is similar to the third embodiment. In the fourth embodiment, both side edges of the opening end 41*c* of large-diameter bore 41*a* are formed integral with respective circumferentially-opposed protrusions 1*f*, 1*f* configured to narrow the opening end 41*c*. When assembling, the inner end face 43*c* of the lock-hole structural section 43*a* of the first lock-hole structural member 43 is brought into press-contact (press-fit) with the inner wall surfaces of protrusions 1*f*, 1*f*.

Hence, in the fourth embodiment, after the first lock-hole structural member 43 has been press-fitted into the first retaining hole 41, a free rotary motion of the first lock-hole structural member 43 with respect to the first retaining hole 41 can be certainly restricted by abutted-engagement of flat both side faces 43*g*, 43*g* of lock-hole structural section 43*a* with flat both side faces 41*f*, 41*f* of large-diameter bore 41*a*, and by press-contact (press-fit) of the inner end face 43*c* of lock-hole structural section 43*a* with the inner wall surfaces of protrusions 1*f*, 1*f*. This enables more precise positioning or locating of the first lock-hole structural member 43 with respect to the first retaining hole 41 and high-precision press-fitting work of the first lock-hole structural member 43 into the first retaining hole 41.

In the shown embodiment, the variable valve actuation apparatus (the VTC device) is applied to the intake valve side of an internal combustion engine. In lieu thereof, the variable valve actuation apparatus (the VTC device) of the embodiments may be applied to the exhaust valve side.

Also, the variable valve actuation apparatus of the shown embodiment is exemplified in a non-idle-stop-system equipped vehicle not having a so-called idle-stop function (exactly, an idle-reduction function). In lieu thereof, the variable valve actuation apparatus of the shown embodiment may be applied to a so-called automatic-engine-stop-system equipped vehicle or a hybrid vehicle in which at least one of an internal combustion engine and a motor/generator can be selected as a propelling power source depending on an engine/vehicle operating condition.

The entire contents of Japanese Patent Application No. 2013-194159 (filed Sep. 19, 2013) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve actuation apparatus of an internal combustion engine, comprising:

a driving rotary member adapted to be driven by a crankshaft of the engine and configured to define therein a working-fluid chamber;

a vane rotor adapted to be fixedly connected to a camshaft and configured to partition the working-fluid chamber into a phase-advance hydraulic chamber and a phase-retard hydraulic chamber and configured to relatively rotate in either one of a phase-advance direction and a phase-retard direction with respect to the driving rotary member by selectively supplying working fluid to one of the phase-advance hydraulic chamber and the phase-retard hydraulic chamber and draining working fluid from the other of the phase-advance hydraulic chamber and the phase-retard hydraulic chamber;

a slide bore formed in the vane rotor as an axial through hole extending along an axial direction of the camshaft;

a lock member slidably disposed in the slide bore;

a retaining hole formed in an inner face of the driving rotary member so as to face the working-fluid chamber; and a lock-hole structural member fixed into the retaining hole and configured to form a lock hole with which a tip of the lock member is brought into engagement when the vane rotor has relatively rotated to a predetermined angular position with respect to the driving rotary member, wherein a flat surface is formed along a given part of an inner peripheral surface of the retaining hole, and wherein a planar section is formed along a given part of an outer peripheral surface of the lock-hole structural member, the planar section being configured to abut the flat surface of the retaining hole.

2. The variable valve actuation apparatus of an internal combustion engine, as recited in claim 1, wherein:

the retaining hole comprises a large-diameter bore formed to face the working-fluid chamber and a small-diameter bore formed in a bottom face of the large-diameter bore; and the lock-hole structural member comprises a lock-hole structural section configured to be retained in the large-diameter bore and having the lock hole formed in a top end of the lock-hole structural section, and a press-fit section protruding from a bottom of the lock-hole structural section and configured to be press-fitted into the small-diameter bore.

3. The variable valve actuation apparatus of an internal combustion engine, as recited in claim 2, wherein:

the planar section is formed on an outer peripheral surface of the lock-hole structural section, and the flat surface of the retaining hole is formed on an inner peripheral surface opposed to the outer peripheral surface of the lock-hole structural section, the planar section being arranged along the flat surface and brought into abutment with the flat surface.

4. The variable valve actuation apparatus of an internal combustion engine, as recited in claim 3, wherein:

the lock-hole structural section of the lock-hole structural member is retained in the large-diameter bore of the retaining hole.

5. The variable valve actuation apparatus of an internal combustion engine, as recited in claim 2, wherein:

the press-fit section is press-fitted into the small-diameter bore by movement of the planar section into the large-diameter bore along the flat surface, when fixing the lock-hole structural member into the retaining hole.

6. The variable valve actuation apparatus of an internal combustion engine, as recited in claim 2, wherein:

a chamfered portion is formed at an edge of the planar section of the outer peripheral surface of the lock-hole structural member, facing the press-fit section.

7. The variable valve actuation apparatus of an internal combustion engine, as recited in claim 6, wherein:

a depth of the large-diameter bore is dimensioned to be greater than an axial length of the lock-hole structural member from an uppermost end of the chamfered portion to a lowermost end of an effective press-fit part of the press-fit section.

8. The variable valve actuation apparatus of an internal combustion engine, as recited in claim 1, wherein:

the vane rotor comprises a substantially cylindrical-hollow rotor and a plurality of radially-protruding vanes formed on an outer periphery of the vane rotor; and the driving rotary member has a support bore into which the rotor is rotatably inserted, and a radially inside end of the retaining hole is formed as an inside opening end opened into the support bore of the driving rotary member.

9. The variable valve actuation apparatus of an internal combustion engine, as recited in claim 1, wherein:

a radial dimension of the lock-hole structural member in a radial direction of the driving rotary member is dimensioned to be less than a circumferential dimension of the lock-hole structural member in a circumferential direction of the driving rotary member.

10. The variable valve actuation apparatus of an internal combustion engine, as recited in claim 1, wherein:

the lock hole is formed into a circumferentially-elongated elliptic shape.

11. The variable valve actuation apparatus of an internal combustion engine, as recited in claim 1, wherein:

the lock hole is formed as a stepped hole having a plurality of bottom faces configured to lower stepwise.

12. A variable valve actuation apparatus of an internal combustion engine, comprising:

a driving rotary member adapted to be driven by a crankshaft of the engine and configured to define therein a working-fluid chamber;

a vane rotor adapted to be fixedly connected to a camshaft and configured to partition the working-fluid chamber into a phase-advance hydraulic chamber and a phase-retard hydraulic chamber and configured to relatively rotate in either one of a phase-advance direction and a phase-retard direction with respect to the driving rotary member by selectively supplying working fluid to one of the phase-advance hydraulic chamber and the phase-retard hydraulic chamber and draining working fluid from the other of the phase-advance hydraulic chamber and the phase-retard hydraulic chamber;

a slide bore formed in the vane rotor as an axial through hole extending along an axial direction of the camshaft;

a lock member slidably disposed in the slide bore;

a stepped recessed portion formed in an inner face of the driving rotary member so as to face the working-fluid chamber; and a lock-hole structural member fixed into the stepped recessed portion and configured to form a lock hole with which a tip of the lock member is brought into engagement when the vane rotor has relatively rotated to a predetermined angular position with respect to the driving rotary member, wherein a flat surface is formed along a given part of an inner peripheral surface of the stepped recessed portion, and wherein a planar section is formed along a given part of an outer peripheral surface of the lock-hole structural member, the planar section being configured to abut the flat surface of the stepped recessed portion.

13. The variable valve actuation apparatus of an internal combustion engine, as recited in claim 1, wherein:

the driving rotary member has a rear cover whose outer periphery is formed with a sprocket gear, and a support bore is formed in the rear cover as an axial through hole into which a rotor of the vane rotor is rotatably inserted; and the retaining hole is formed at an inner peripheral side of the rear cover, facing the support bore, and a radially inside end of the retaining hole is formed as an inside opening end opened into the support bore of the driving rotary member.

14. The variable valve actuation apparatus of an internal combustion engine, as recited in claim 1, wherein:

the retaining hole comprises a large-diameter bore formed to face the working-fluid chamber and a small-diameter bore formed in a substantially center of a bottom face of the large-diameter bore; and the lock-hole structural member comprises a lock-hole structural section configured to be retained in the large-diameter bore and having the lock hole formed in a top end of the lock-hole structural section, and a press-fit section protruding from a bottom of the lock-hole structural section and configured to be press-fitted into the small-diameter bore.

15. The variable valve actuation apparatus of an internal combustion engine, as recited in claim 14, wherein:

the planar section comprises two planar sections formed as both outside faces of the lock-hole structural member, and the flat surface comprises two flat surfaces formed as both inside faces of the retaining hole, opposed to the both outside faces, the two planar sections being arranged along the flat surfaces and brought into abutment with the flat surfaces respectively.

16. The variable valve actuation apparatus of an internal combustion engine, as recited in claim 15, wherein:

the press-fit section is press-fitted into the small-diameter bore by movement of the two planar sections into the large-diameter bore along the respective flat surfaces, when fixing the lock-hole structural member into the retaining hole.

17. The variable valve actuation apparatus of an internal combustion engine, as recited in claim 16, wherein:

the both outside faces are formed as width across flats on the outer peripheral surface of the lock-hole structural member, whereas the both inside faces are formed as two opposing inside faces on the inner peripheral surface of the retaining hole and configured to abut the respective width across flats of the lock-hole structural member.

18. The variable valve actuation apparatus of an internal combustion engine, as recited in claim 15, wherein:

a depth of the small-diameter bore of the retaining hole is dimensioned to be greater than an axial length of the press-fit section of the lock-hole structural member.

19. The variable valve actuation apparatus of an internal combustion engine, as recited in claim 18, wherein:

a tapered guide surface is formed at an edge of an inner circumference between the large-diameter bore and the small-diameter bore of the retaining hole.

20. The variable valve actuation apparatus of an internal combustion engine, as recited in claim 15, wherein:

a thickness between an outer peripheral surface of the lock-hole structural section and an inner peripheral surface of the lock hole is dimensioned such that a radially inside part of the lock-hole structural member, opposed to a radially outside part of the lock-hole structural member along which the planar section is formed, is thicker than the radially outside part of the lock-hole structural member.

* * * * *